US010022689B2

(12) United States Patent
Shareef et al.

(10) Patent No.: US 10,022,689 B2
(45) Date of Patent: Jul. 17, 2018

(54) FLUID MIXING HUB FOR SEMICONDUCTOR PROCESSING TOOL

(71) Applicant: Lam Research Corporation, Fremont, CA (US)

(72) Inventors: Iqbal A. Shareef, Fremont, CA (US); Mark Taskar, San Mateo, CA (US)

(73) Assignee: Lam Research Corporation, Fremont, CA (US)

( * ) Notice: Subject to any disclaimer, the term of this patent is extended or adjusted under 35 U.S.C. 154(b) by 172 days.

(21) Appl. No.: 14/809,041

(22) Filed: Jul. 24, 2015

(65) Prior Publication Data

US 2017/0021317 A1 Jan. 26, 2017

(51) Int. Cl.

*B01F 15/02* (2006.01)
*B01F 3/02* (2006.01)
*B01F 13/10* (2006.01)

(52) U.S. Cl.

CPC ..... *B01F 15/0226* (2013.01); *B01F 3/02* (2013.01); *B01F 13/1058* (2013.01); *B01F 15/0222* (2013.01); *B01F 2215/0096* (2013.01)

(58) Field of Classification Search

CPC ..... B01F 15/026; B01F 15/0222; B01F 15/0226; B01F 3/02; B01F 2215/0096; B01F 15/0203; B01F 15/0201

USPC ..... 366/173.1, 177.1

See application file for complete search history.

(56) References Cited

U.S. PATENT DOCUMENTS 2,361,150 A * 10/1944 Petroe ..... B01F 5/0451 137/44
2,569,857 A * 10/1951 Jaegle ..... B01F 5/0413 137/515.5
3,026,183 A * 3/1962 Cole, III ..... B29B 7/404 137/315.01

(Continued)

FOREIGN PATENT DOCUMENTS

JP 2003-334479 A 11/2003
JP 2004-214591 A 7/2004

(Continued)

OTHER PUBLICATIONS

U.S. Office Action, dated Jun. 22, 2017, issued in U.S. Appl. No. 14/517,192.

(Continued)

*Primary Examiner* — Tony G Soohoo
(74) *Attorney, Agent, or Firm* — Weaver Austin Villeneuve & Sampson LLP

(57) ABSTRACT

A mixing hub for use in semiconductor processing tools is provided. The hub may include a plurality of ports arranged about an axis, a mixing chamber, and a plurality of flow paths. Each of the flow paths may fluidically connect a corresponding one of the ports to the mixing chamber and each flow path may include a first passage, a second passage, and a valve interface. Each valve interface may be configured to interface with a valve such that the valve, when installed in the valve interface, is able to regulate fluid flow between the first passage and the second passage. Each valve interface may be located between a first reference plane that is perpendicular to the axis and passes through the corresponding port and a second reference plane that is perpendicular to the axis and passes through the mixing chamber.

20 Claims, 13 Drawing Sheets

(56) References Cited

U.S. PATENT DOCUMENTS 3,102,004 A * 8/1963 Grintz ..... B29B 7/404 239/548
3,865,133 A * 2/1975 Alford ..... F16K 15/145 137/512
4,099,919 A * 7/1978 Leidal ..... B29B 7/7684 366/159.1
4,134,002 A 1/1979 Stanford
4,215,081 A * 7/1980 Brooks ..... B01F 3/04517 261/122.1
4,264,212 A * 4/1981 Tookey ..... B01F 5/0403 239/433
4,422,471 A 12/1983 Faccini
4,545,328 A 10/1985 Fujiyama et al.
4,581,521 A 4/1986 Grise
4,703,718 A 11/1987 Enstrom
4,714,091 A 12/1987 Wagner
5,063,027 A * 11/1991 Schneider ..... B29B 7/7668 366/162.4
5,082,633 A * 1/1992 Stuper ..... B29B 7/7694 239/550
5,534,328 A * 7/1996 Ashmead ..... B01F 5/0604 210/150
5,794,645 A 8/1998 Rohrberg et al.
5,836,355 A 11/1998 Markulec et al.
5,887,977 A * 3/1999 Morikawa ..... B01F 5/0604 138/42
5,911,342 A * 6/1999 Sindoni ..... B01F 13/1058 141/104
5,950,874 A * 9/1999 Sindoni ..... B01F 13/1058 141/104
5,984,519 A * 11/1999 Onodera ..... B01F 3/12 366/165.2
6,068,016 A 5/2000 Manofsky, Jr. et al.
6,073,646 A 6/2000 Kimura
6,125,887 A 10/2000 Pinto
6,159,442 A * 12/2000 Thumm ..... B01J 3/00 239/420
6,168,948 B1 1/2001 Anderson et al.
6,186,177 B1 2/2001 Maher
6,260,581 B1 7/2001 Hollingshead
6,269,978 B1 * 8/2001 Sindoni ..... B01F 13/1058 222/144.5
6,283,143 B1 9/2001 Adachi, Jr. et al.
6,283,155 B1 9/2001 Vu
6,302,141 B1 10/2001 Markulec et al.
6,352,594 B2 3/2002 Cook et al.
6,440,504 B1 8/2002 Akiyama
6,546,960 B1 4/2003 Rohrberg et al.
6,581,640 B1 6/2003 Barron
6,640,835 B1 11/2003 Rohrberg et al.
6,648,020 B2 11/2003 Fujimoto et al.
6,655,829 B1 * 12/2003 Vanden Bussche ..... B01F 5/04 366/165.1
6,718,817 B1 4/2004 Ko et al.
6,753,200 B2 6/2004 Craighead et al.
6,880,745 B2 4/2005 Stueber et al.
6,907,904 B2 6/2005 Harris et al.
7,055,550 B2 6/2006 Harris et al.
7,126,094 B2 10/2006 Bower et al.
7,140,558 B2 * 11/2006 McCracken ..... B01F 5/0256 239/422
7,150,475 B2 12/2006 Eriksson et al.
7,178,556 B2 2/2007 Reid, II et al.
7,195,037 B2 3/2007 Eidsmore
7,225,835 B2 6/2007 Vu
7,234,222 B1 6/2007 Hao et al.
7,261,812 B1 8/2007 Karp et al.
7,299,825 B2 11/2007 Milburn
7,307,247 B2 12/2007 Bower et al.
7,320,339 B2 1/2008 Milburn
7,334,605 B2 2/2008 Vu
7,404,417 B2 7/2008 Eidsmore
7,410,519 B1 8/2008 Ewald
7,789,107 B2 9/2010 Eriksson et al.
7,798,388 B2 9/2010 Crockett et al.
7,806,143 B2 10/2010 Taskar
7,892,357 B2 2/2011 Srivastava
7,976,795 B2 7/2011 Zhou et al.
8,122,910 B2 2/2012 Taskar
8,196,480 B1 6/2012 Mayeaux
8,196,609 B2 6/2012 Oya et al.
8,322,380 B2 12/2012 Taskar
8,340,827 B2 12/2012 Yun et al.
8,521,461 B2 8/2013 Shareef et al.
8,746,284 B2 6/2014 DeDontney
8,794,267 B2 8/2014 Shareef et al.
8,846,183 B2 9/2014 Unger et al.
8,851,113 B2 10/2014 Taskar et al.
8,852,685 B2 10/2014 Kenworthy et al.
9,879,795 B2 1/2018 Burkhart et al.
2002/0017329 A1 2/2002 Fukushima
2002/0072164 A1 6/2002 Umotyo et al.
2002/0176317 A1 * 11/2002 Bellasalma ..... B01F 15/0201 366/182.4
2003/0124842 A1 7/2003 Hytros et al.
2004/0091406 A1 * 5/2004 Wolfert ..... B01F 5/0403 422/224
2004/0092118 A1 5/2004 Johnson et al.
2004/0125689 A1 * 7/2004 Ehrfeld ..... B01F 5/04 366/165.1
2004/0189311 A1 9/2004 Glezer et al.
2004/0231586 A1 * 11/2004 Dugue ..... B01F 5/0475 118/715
2005/0005981 A1 1/2005 Eidsmore et al.
2005/0104242 A1 5/2005 Olaru
2005/0284529 A1 12/2005 Iwabuchi
2006/0028908 A1 * 2/2006 Suriadi ..... B01F 13/0079 366/146
2007/0007204 A1 * 1/2007 Schanz ..... B01D 11/0453 210/634
2007/0138203 A1 * 6/2007 Sacchet ..... B01F 13/1058 222/144
2007/0140042 A1 * 6/2007 Schanz ..... B01F 5/0475 366/130
2007/0253281 A1 * 11/2007 Radford ..... B01F 5/0475 366/173.1
2007/0291581 A1 * 12/2007 Ehrfeld ..... B01F 5/0077 366/153.2
2008/0066859 A1 3/2008 Kobayashi et al.
2008/0106968 A1 * 5/2008 Schanz ..... B01F 5/0475 366/134
2009/0071556 A1 * 3/2009 Bourlart ..... B01F 3/02 137/597
2009/0120364 A1 5/2009 Suarez et al.
2010/0067323 A1 * 3/2010 Blom ..... B01F 5/0057 366/165.2
2011/0005601 A1 1/2011 Shareef et al.
2011/0158931 A1 * 6/2011 Wittek ..... B01F 3/0807 424/78.03
2012/0175442 A1 * 7/2012 Xiong ..... B01F 5/0256 241/15
2012/0237696 A1 9/2012 Huseinovic et al.
2012/0263012 A1 * 10/2012 Xiong ..... B01F 5/0256 366/134
2013/0025718 A1 1/2013 Nagase et al.
2013/0248511 A1 9/2013 Wallinger
2013/0255782 A1 10/2013 Shareef et al.
2013/0255883 A1 10/2013 Shareef et al.
2014/0020779 A1 1/2014 Vu
2014/0076236 A1 3/2014 Sankarakrishnan et al.
2014/0090599 A1 4/2014 Saitou
2014/0137961 A1 5/2014 Kao et al.
2014/0182689 A1 7/2014 Shareef et al.
2014/0202577 A1 7/2014 Webster, III
2014/0241960 A1 * 8/2014 Mochizuki ..... B01F 5/12 422/633
2015/0362080 A1 12/2015 Vu
2016/0111257 A1 4/2016 Kellogg et al.
2017/0021317 A1 * 1/2017 Shareef ..... B01F 15/026

(56) References Cited

U.S. PATENT DOCUMENTS

| | | | |
|---|---|---|---|
| 2017/0173886 | A1 | 6/2017 | Menchik et al. |
| 2017/0203511 | A1 | 7/2017 | Burkhart et al. |

FOREIGN PATENT DOCUMENTS

| | | | |
|---|---|---|---|
| KR | 10-2009-0125681 | | 12/2009 |
| WO | WO 2014/199158 | A1 | 12/2014 |
| WO | WO 2016/061493 | A1 | 4/2016 |

OTHER PUBLICATIONS

U.S. Final Office Action, dated Nov. 16, 2017, issued in U.S. Appl. No. 14/517,192.
U.S. Office Action, dated Dec. 30, 2016, issued in U.S. Appl. No. 14/997,419.
U.S. Final Office Action, dated Jul. 10, 2017, issued in U.S. Appl. No. 14/997,419.
U.S. Notice of Allowance, dated Sep. 27, 2017, issued in U.S. Appl. No. 14/997,419.
U.S. Notice of Allowance (Corrected), dated Jan. 3, 2018, issued in U.S. Appl. No. 14/997,419.
U.S. Office Action, dated Dec. 15, 2017, issued in U.S. Appl. No. 15/087,889.
U.S. Office Action, dated Dec. 15, 2017, issued in U.S. Appl. No. 14/680,244.
PCT International Search Report and Written Opinion dated Dec. 28, 2015 issued in PCT/US2015/0555997.
PCT International Preliminary Report on Patentability and Written Opinion dated Apr. 27, 2017 issued in PCT/US2015/0555997.

* cited by examiner

FLUID MIXING HUB FOR SEMICONDUCTOR PROCESSING TOOL

BACKGROUND

Semiconductor manufacturing processes utilize a variety of different types of process gases that must be delivered with precise timing and in precise quantities and/or at precise delivery rates. In some cases, a semiconductor processing tool may utilize ten or more process gases, e.g., 14 different process gases, each of which must have its own separate control hardware. This collection of control hardware, which may include valves, mass flow controllers (MFCs), tubing, fittings, etc., is typically housed in a "gas box," which is a cabinet or other structure that is typically mounted to the semiconductor processing tool (or in another location nearby).

SUMMARY

Figure 1:
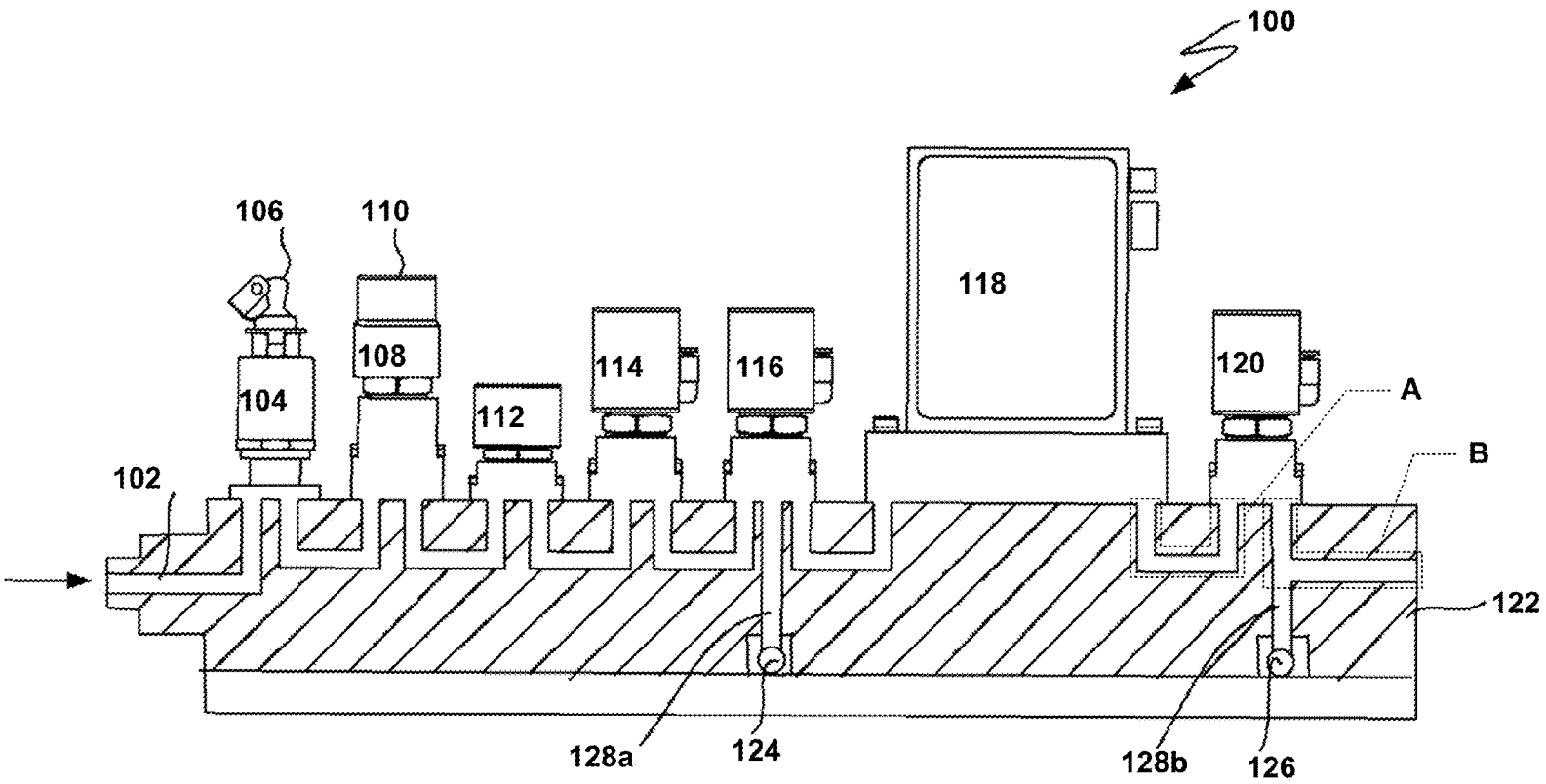
FIG. 1 depicts one example of a typical gas stick arrangement used in conventional gas boxes.

In one embodiment, an apparatus may be provided. The apparatus may include a first hub that may have a plurality of first ports arranged about a first axis, a first mixing chamber offset from one of the first ports in a direction parallel to the first axis by a first distance, and a plurality of first flow paths. Each of the first flow paths may fluidically connect a corresponding one of the first ports to the first mixing chamber and each first flow path may include a first passage, a second passage, and a first valve interface. For each first flow path, the first passage may fluidically connect the corresponding first port with the first valve interface, the second passage may fluidically connect the first valve interface with the first mixing chamber, the first valve interface may be fluidically interposed between the first passage and the second passage, each first valve interface may be configured to interface with a first valve such that the first valve, when installed, is able to regulate fluid flow between the first passage and the second passage, and the first valve interface may be located between a first reference plane that is perpendicular to the first axis and passes through the corresponding first port and a second reference plane that is perpendicular to the first axis and passes through the first mixing chamber.

In some embodiments, the first ports may be arranged in a first radial pattern around the first axis.

In some embodiments, the first hub may also include at least three first ports and three first flow paths In some embodiments, the first mixing chamber may be hemispherical in shape.

In one such embodiment, each first valve interface may include a valve mounting feature, such as a threaded bore or a pattern of threaded holes.

In further such embodiments, the threaded bore or threaded holes may have a center axis or center axes that are within 10° of perpendicular to the first axis.

In some embodiments, the apparatus may further include one or more first surfaces and one or more second surfaces. Each first port may be located on one of the one or more first surfaces, each second surface may be substantially perpendicular to the first surface, and/or each first valve interface may extend through one of the one or more second surfaces.

In some embodiments, the apparatus may also include a first outflow pipe that may be fluidically connected to the first mixing chamber.

In one such embodiment, the first hub may also include first mounting features that may be configured to mount a plurality of first fluid flow components to the first hub such that each first fluid flow component is fluidically connected with a corresponding one of the first flow paths via one of the first ports.

In further such embodiments, the first mounting features and the first valve interfaces of the first hub may be configured such that when one of the first valves is interfaced with one of the first valve interfaces and one of the first fluid flow components is mounted to the first hub using the first mounting features such that the first valve and the first fluid flow component fluidically interface with a corresponding one of the first flow paths, the first fluid flow component and the first valve overlap, at least in part, when viewed from a direction parallel to the first axis.

In further such embodiments, the apparatus may further include a plurality of first fluid flow components and a plurality of first valves. Each first fluid flow component may be mounted to the first hub using the first mounting features such that each first fluid flow component is fluidically connected with a corresponding one of the first ports, and each first valve may be interfaced with a corresponding one of the first valve interfaces.

In one such embodiment, the first passages may be at a first oblique angle off the first reference plane and the second passages may be at a second oblique angle off the first reference plane.

In further such embodiments, the absolute value of the difference between the first oblique angle and the second oblique angle may be 20° or less.

In some embodiments, the apparatus may also include a third surface which may be offset from one of the first ports in a direction parallel to the first axis by a first distance. The first mixing chamber may also extend through the third surface and the third surface may be configured to fluidically connect the first mixing chamber with a first mixing chamber of another hub.

In one such embodiment, the apparatus may further include a second hub that may have a plurality of second ports arranged about a second axis, a second mixing chamber offset from one of the second ports in a direction parallel to the second axis by a second distance, and a plurality of second flow paths. Each of the second flow paths may fluidically connect a corresponding one of the second ports to the second mixing chamber and each second flow path and may include a third passage, a fourth passage, and a second valve interface. For each second flow path, the third passage may fluidically connect the corresponding second port with the second valve interface, the fourth passage may fluidically connect the second valve interface with the second mixing chamber, the second valve interface may be fluidically interposed between the third passage and the fourth passage, each second valve interface may be configured to interface with a second valve such that the second valve, when installed, is able to regulate fluid flow between the third passage to the fourth passage, and the second valve interface may be located between a third reference plane that is perpendicular to the second axis and passes through the corresponding second port, and a fourth reference plane that is perpendicular to the second axis and passes through the second mixing chamber. An outflow pipe may further be included and may fluidically connect to an item such as the first mixing chamber or the second mixing chamber. The first hub and the second hub may also be assembled together such that the first mixing chamber is fluidically connected to the second mixing chamber.

In further such embodiments, the apparatus may further include a plate that may be sandwiched between the first hub and the second hub when the first hub and the second hub are assembled together.

In further such embodiments, the first hub may further include first mounting features that may be configured to mount a plurality of first fluid flow components to the first hub such that each first fluid flow component is fluidically connected with a corresponding one of the first ports, and the second hub may further include second mounting features that may be configured to mount a plurality of second fluid flow components to the second hub such that each second fluid flow component is fluidically connected with a corresponding one of the second ports.

In one further such embodiment, the first mounting features and the first valve interfaces may be configured such that when one of the first valves is interfaced with one of the first valve interfaces and one of the first fluid flow components is mounted to the first hub using the first mounting features such that the first valve and the first fluid flow component fluidically interface with a corresponding one of the first flow paths, the first fluid flow component and the first valve overlap, at least in part, when viewed from a direction parallel to the first axis, and the second mounting features and the second valve interfaces may be configured such that when one of the second valves is interfaced with one of the second valve interfaces and one of the second fluid flow components is mounted to the second hub using the second mounting features such that the second valve and the second fluid flow component fluidically interface with a corresponding one of the second flow paths, the second fluid flow component and the second valve overlap, at least in part, when viewed from a direction parallel to the second axis.

In one further such embodiment, the apparatus may further include a plurality of first fluid flow components, a plurality of first valves, a plurality of second fluid flow components, and a plurality of second valves. Each first fluid flow component may be mounted to the first hub using the first mounting features such that each first fluid flow component is fluidically connected with a corresponding one of the first ports and each first valve may be interfaced with a corresponding one of the first valve interfaces. Each second fluid flow component may be mounted to the second hub using the second mounting features such that each second fluid flow component is fluidically connected with a corresponding one of the second ports and each second valve may be interfaced with a corresponding one of the second valve interfaces.

In some embodiments, the apparatus may also include a plurality of first fluid flow components, each of which may be mounted to the first hub and in fluidic communication with a different one of the first flow paths; a plurality of first valves, each of which may be mounted to the first hub and in fluidic communication with a corresponding one of the first flow paths through one of the first valve interfaces; at least one semiconductor processing chamber; a gas distribution system that may be configured to supply gas to the semiconductor processing chamber; and a controller that may include at least one memory and at least one processor. The first hub may be fluidically connected with the gas distribution system, the memory may store computer-executable instructions for controlling the plurality of first fluid control components and the plurality of first valves may cause desired quantities of process gases, process liquids, or process gases and process liquids to be delivered to the first mixing chamber and then to the at least one semiconductor processing chamber by way of the gas distribution system.

DETAILED DESCRIPTION

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific implementations, it will be understood that these implementations are not intended to be limiting.

There are many concepts and implementations described and illustrated herein. While certain features, attributes and advantages of the implementations discussed herein have been described and illustrated, it should be understood that many others, as well as different and/or similar implementations, features, attributes and advantages of the present inventions, are apparent from the description and illustrations. As such, the above implementations are merely exemplary. They are not intended to be exhaustive or to limit the disclosure to the precise forms, techniques, materials and/or configurations disclosed. Many modifications and variations are possible in light of this disclosure. It is to be understood that other implementations may be utilized and operational changes may be made without departing from the scope of the present disclosure. As such, the scope of the disclosure is not limited solely to the description above because the description of the above implementations has been presented for the purposes of illustration and description.

Importantly, the present disclosure is neither limited to any single aspect nor implementation, nor to any single combination and/or permutation of such aspects and/or implementations. Moreover, each of the aspects of the present disclosure, and/or implementations thereof, may be employed alone or in combination with one or more of the other aspects and/or implementations thereof. For the sake of brevity, many of those permutations and combinations will not be discussed and/or illustrated separately herein.

Semiconductor processes typically utilize a large number of different types of processing gases and/or liquids. These fluids may need to be individually controlled to a high degree of precision to ensure that the proper quantities and ratios of gases are delivered to the semiconductor processing chamber (or chambers) where semiconductor processing occurs at the right time and in the right sequence—it is to be understood that the term "fluid," as used herein, may refer to either a gas or a liquid. To provide such fluidic control, semiconductor processing tools usually include, or are connected with, a "gas box," which is a complex assembly of fluid flow components, such as valves, mass flow controllers (MFCs), fittings, tubes, manifold blocks, etc.

In a typical gas box, each processing fluid may have an associated "gas stick," which is typically a linear arrangement of shut-off valves, mixing valves, MFCs (if used), fittings, tubing, filters, pressure regulators, and/or manifold blocks. These gas sticks, which may also be used for liquid reactants (despite the name referring to "gas"), may then be arranged in a linear fashion, side-by-side, and connected to a common trunk line. In such arrangements, the average flow direction of each gas stick may typically be perpendicular to the average flow direction of the trunk line.

In a typical gas stick, the fluid flow components are laid out in a generally sequential manner. FIG. 1 depicts an example of a typical gas stick arrangement used in conventional gas boxes.

Referring to FIG. 1, the gas stick 100 may have a gas stick input port 102 that may be connected to a supply fluid source, e.g., a facility gas source. A manual valve 104 may be used to allow for the supply or isolation of the supply fluid source from the gas stick (or vice versa). The manual valve 104 may also have a lockout/tagout device 106 that prevents the manual valve 104 from being operated until the lockout is disengaged, or that indicates prominently that the valve is in-use and should not be operated except by the person who set the tag. Worker safety regulations often mandate that plasma processing manufacturing equipment include activation prevention capability, such as a lockout/tagout mechanism. Generally a lockout is a device that uses a lock of some sort, either key or combination type, to hold an energy-isolating device in a safe position. A tagout device is generally any prominent warning device, such as a tag, that can be securely fastened to energy-isolating device in accordance with an established procedure.

A regulator 108 may be used to regulate the pressure of the supply fluid, e.g., the pressure of a supply gas, and a pressure gauge 110 may be used to monitor the pressure of the supply fluid. In one implementation, the pressure may be preset and not need to be regulated. In another implementation, a pressure transducer (not illustrated) having a display to display the pressure may be used. The pressure transducer may be positioned next to the regulator 108. A filter 112 may be used to remove impurities in the supply fluid. A primary shut-off valve 114 may be used to prevent any corrosive supply fluids from remaining in the gas stick. The primary shut-off valve 114 may be two-port valve having an automatic pneumatically operated valve assembly that causes the valve to become deactivated (closed), which in turn effectively stops fluid flow within the gas stick. Once deactivated, a non-corrosive purge gas, such as nitrogen, may be used to purge the gas stick. The purge valve 116 may have three ports to provide for the purge process—an entrance port, an exit port and a discharge port.

Adjacent the purge valve 116 may be an MFC 118. The MFC 118 may be used to accurately measure and control the flow rate of the supply fluid, e.g., supply gas. Positioning the purge valve 116 next to the MFC 118 allows a user to purge any corrosive supply fluids in the MFC 118. A mixing valve (or secondary valve) 120 next to the MFC 118 may be used to release the amount of supply fluid to be mixed with other supply fluids in the gas box.

Each component of the gas stick 100 may be positioned above a manifold block. A plurality of manifold blocks may be joined together to form a substrate 122, which may be a layer of manifold blocks that creates the flow path of fluid through the gas stick 100. The fluid flow components may be positioned on the manifold blocks through any of a variety of mechanisms, e.g, threaded interfaces, flange plates with threaded fasteners, etc.

In such arrangements, each gas stick may be located a different distance from the end of the trunk line that serves as the supply to the semiconductor processing chamber. In such arrangements, it may take longer for gases that are introduced into the trunk line further from such a supply end to reach the supply end than gases that are introduced into the trunk line closer to the supply end.

In some of these arrangements, a high-flow carrier gas may be introduced into the trunk line to convey lower-flow process gases from the gas sticks to the supply end of the trunk line in a more rapid fashion, which may reduce the time it takes to deliver process fluids to the trunk line supply end.

The assignee of this disclosure has undertaken to fundamentally change the design of gas boxes for use in semiconductor manufacturing to make these systems more streamlined, more compact, and less expensive. As part of this effort, the present inventors determined that significantly improved fluid delivery could be obtained in a gas box where a) each MFC was linked to a common mixing chamber by generally equal-length flow passages and b) the MFCs were generally arranged in a circular pattern about the mixing chamber. Typically speaking, the MFC is the next-to-last (with respect to the direction of fluid flow) fluid flow component in a gas stick—it is usually the component that controls the rate at which gas or liquid is delivered to the mixing chamber/trunk line/or other volume in which the various fluids delivered by the gas sticks may mingle. The last fluid flow component in a gas stick, however, is usually a mixing valve that may start or stop flow of the fluid passing through the MFC. In addition to arranging the MFCs around the mixing chamber in a generally circular pattern and using generally equal-length flow passages between the MFCs and the mixing chamber, the present inventors also determined that a radical reconfiguration of the mixing valve and MFC relative placement provided additional performance increases.

Instead of the mixing valve being located as shown in FIG. 1, e.g., with the mixing valve and the MFC both generally mounted to fluidic interfaces facing the same direction and adjacent to one another, the present inventors determined that there were advantages to locating the mixing valve, in effect, in the "shadow" of the MFC.

The above improvements may be provided by way of a mixing hub (or simply "hub") that provides mounting interfaces for various fluid flow components. In most cases, these fluid flow components will include MFC and mixing valve pairs, although other fluid flow components may be mounted to the hub in place of, or in addition to, these fluid flow components. The hub may generally include a mixing chamber that is fluidically connected with a plurality of fluid flow paths arranged about it in a radial arrangement. Each of these fluid flow paths may lead to a different set of fluid flow components and may be used to deliver a different process gas or liquid to the mixing chamber. Such an implementation is discussed in more detail below.

Figure 2:
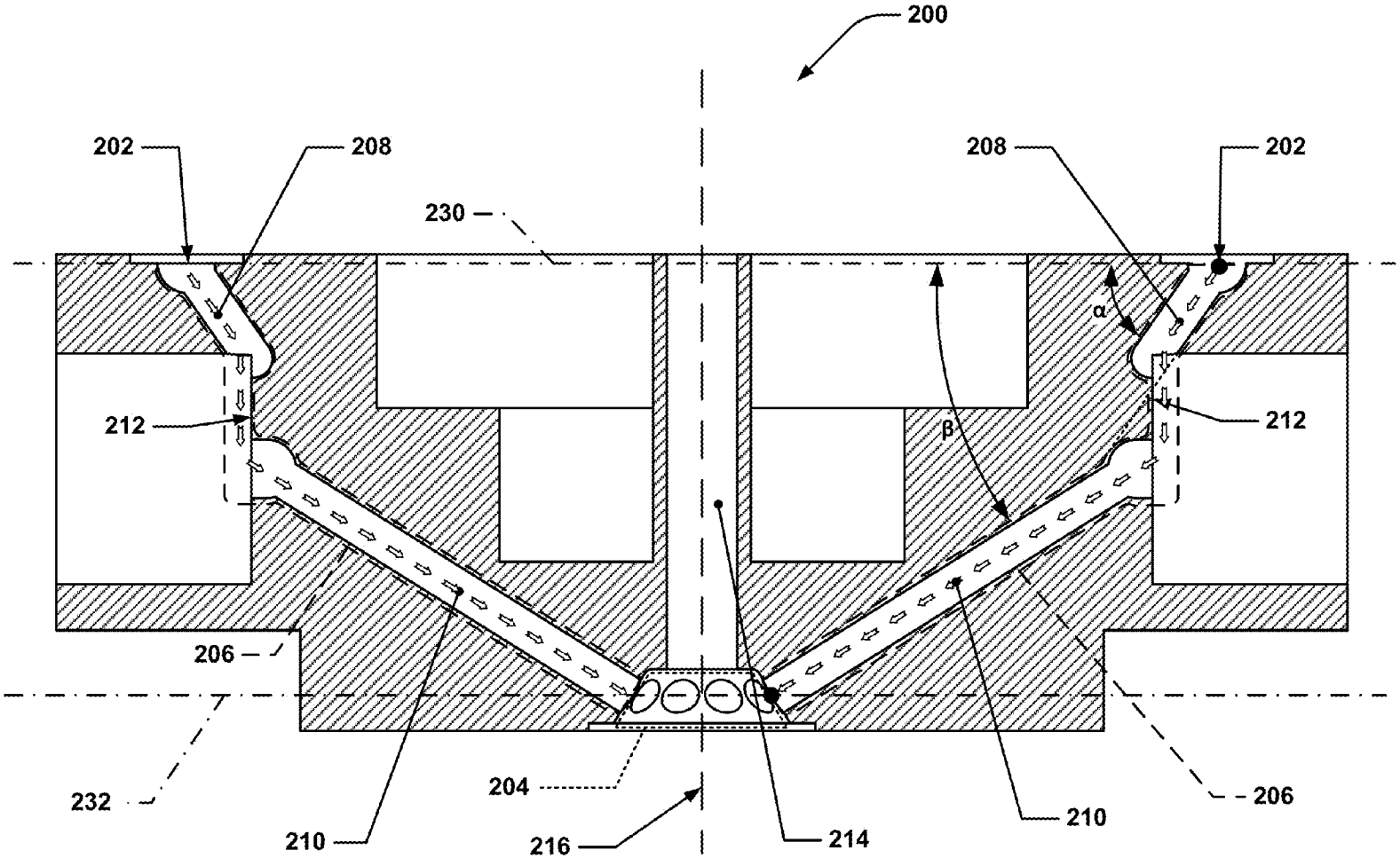
FIG. 2 depicts a cross-sectional view of an example first hub.
Figure 3:
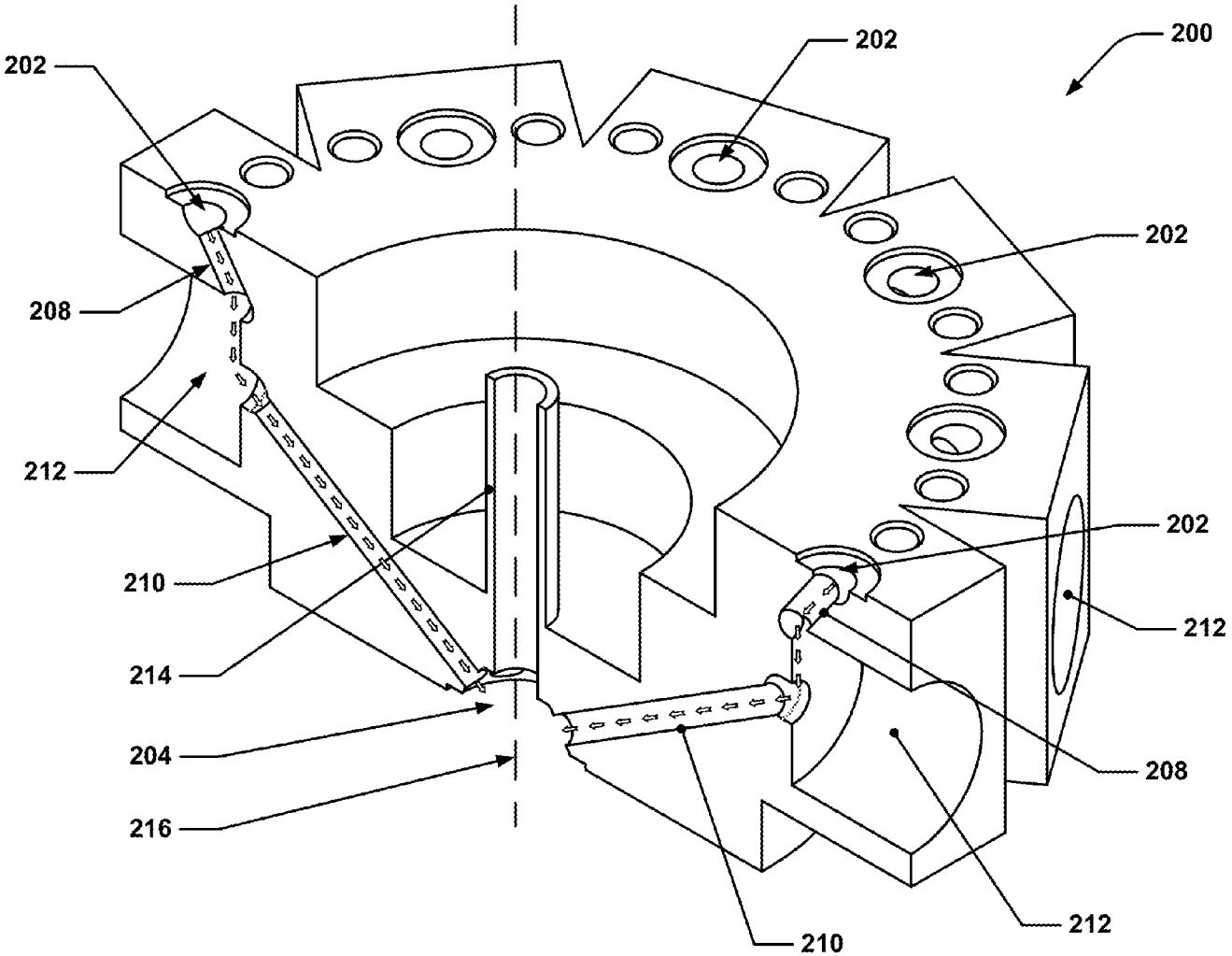
FIG. 3 depicts an isometric cross-sectional view of the example first hub of FIG. 2.

FIG. 2 depicts a sectional side view of an example first hub. FIG. 3 depicts an isometric cross-sectional view of the example first hub of FIG. 2. The example first hub 200 may include a plurality of first ports 202, a first mixing chamber 204, first passages 208, second passages 210, first valve interfaces 212, and a first outflow pipe 214. As can be seen in FIG. 3, the first ports 202 may be arranged about a first axis 216 in a circular array. It is to be understood that while this example shows a circular array of first ports 202 that has equal spacing between the first ports 202, other implementations may feature non-equal spacing between at least some, and, in some cases, all, of the first ports 202. Each first port 202 may be associated with one of the first passages 208, second passages 210, and first valve interfaces 212. The first passage 208, the first valve interface 212, and the second passage 210 associated with each of the first ports 202 may be fluidically connected, in that order, to provide a first flow path 206 (one instance of which is shown in dashed lines in FIG. 2) that may fluidically connect the associated first port 202 with the first mixing chamber 204. It is to be understood that a portion of the first flow path 206 (specifically, the portion that traverses the first valve interface) may be defined by a valve that is to be connected to the first hub when the first hub is assembled with the fluid flow components that will be mounted to it. For the purposes of this disclosure, reference to the "first flow path" is to be understood to refer to the fluid flow volume as it would exist in the hub assembly based on the architecture of the hub and with the valve installed, regardless of whether or not the valve is actually installed.

Thus, for example, each first passage 208 may fluidically connect one first port 202 to a corresponding first valve interface 212. Each second passage 210 may fluidically connect one first valve interface 212 to the first mixing chamber 204. Accordingly, each first valve interface 212 may be fluidically interposed between the corresponding first passage 208 and the second passage 210.

In some configurations, the example first hub 200 may be configured to allow a fluid to travel from the first ports 202 to the first mixing chamber 204 along the first flow paths 206, such that gas may first travel through one first port 202 into one of the first passages 208, then through the first passage 208 that is fluidically connected in series with that first port 202 and into the first valve interface 212 that is fluidically connected in series with that first passage 208, and then through the first valve interface 212 and into the second passage 210 that is fluidically connected in series with the first valve interface 212, and then through that second passage 210 and into the first mixing chamber 204. In some such configurations, each flow path may be fluidically isolated from other first ports 202, first passages 208, and second passages 210 within the hub and upstream of the mixing chamber.

In some configurations, each first valve interface 212 may be configured to regulate fluid flow between the first passage 208 and the second passage 210, which, in some configurations, may be achieved by a valve (not shown, but discussed below and shown in later Figures) that may be interfaced with the first valve interface 212. In some configurations, the first valve interfaces 212 may be substantially cylindrically shaped with a circular cross-section, as depicted in FIG. 3. In some other configurations, one or more of the first valve interfaces 212 may have a different geometric shape and/or cross-section. The valve may be configured to be switchable between configurations that allow unrestricted or semi-restricted fluid flow between the first passage 208 and the second passage 210 and completely restricted flow such that effectively no fluid may flow between the first passage 208 and the second passage 210 (there may be some small amount of flow, depending on the effectiveness of the valve seals—although this leakage flow is generally considered to be negligible). In some configurations, the valve may be configured such that fluid does not flow out of the first valve interface 212 into any volume or passage other than its corresponding first passage 208 and corresponding second passage 210. The first valve interface 212 may be configured to mount a secondary valve or a mixing valve.

Figure 4:
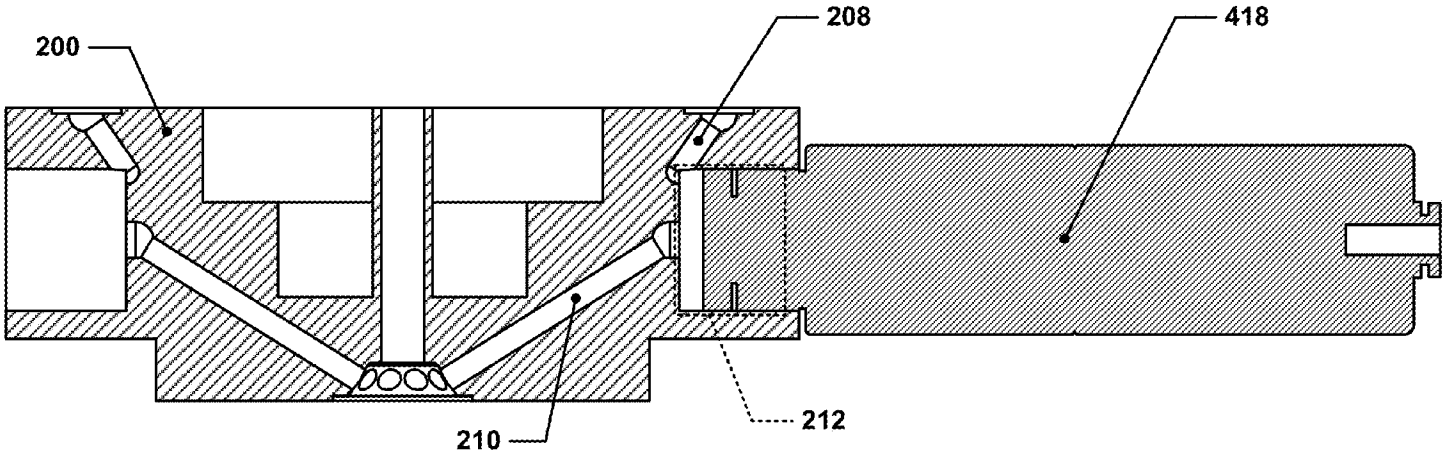
FIG. 4 depicts a cross-sectional view of an example first hub with an example first valve.
Figure 5:
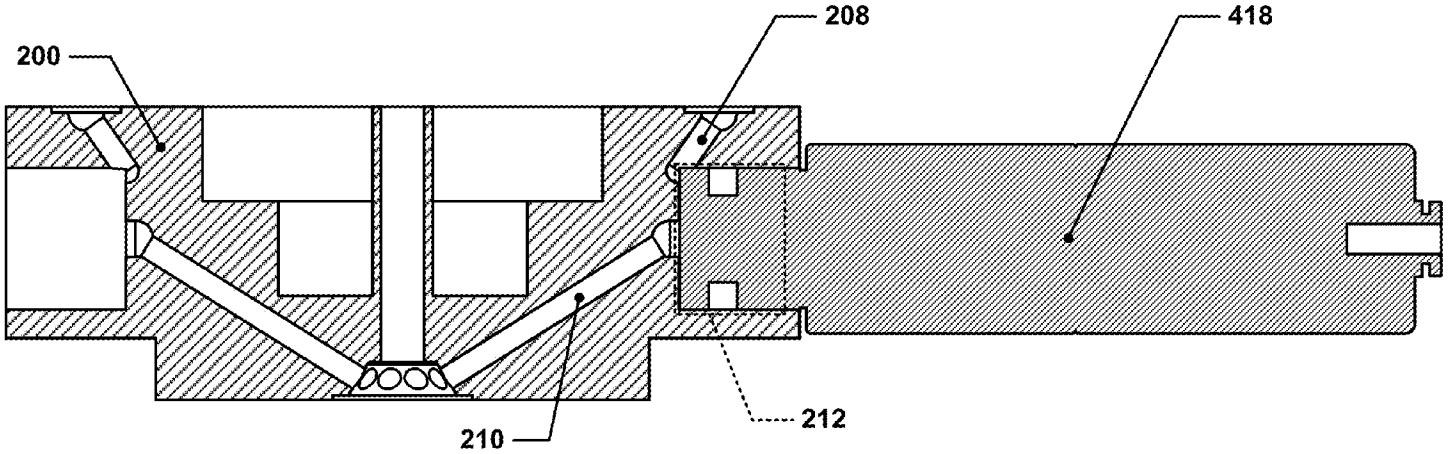
FIG. 5 depicts another cross-sectional view of the first hub of FIG. 4.

FIGS. 4 and 5 are provided in order to illustrate a non-limiting example configuration of a valve restricting and permitting flow between the first passage 208 and the second passage 210. FIG. 4 depicts a cross-sectional view of an example first hub with an example first valve. As can be seen, the example first hub 200 is shown along with a first valve 418 that is interfaced with one first valve interface 212 (the details of the first valve 418 are not shown, only the outer envelope of the first valve 418 is depicted). The first valve 418 is depicted here in an "open" configuration such that fluid may flow between the first passage 208 and the second passage 210.

FIG. 5 depicts another cross-sectional view of the first hub of FIG. 4. As can be seen, the first valve 418 is depicted in a "closed" configuration such that fluid may not flow between the first passage 208 and the second passage 210.

Figure 6:
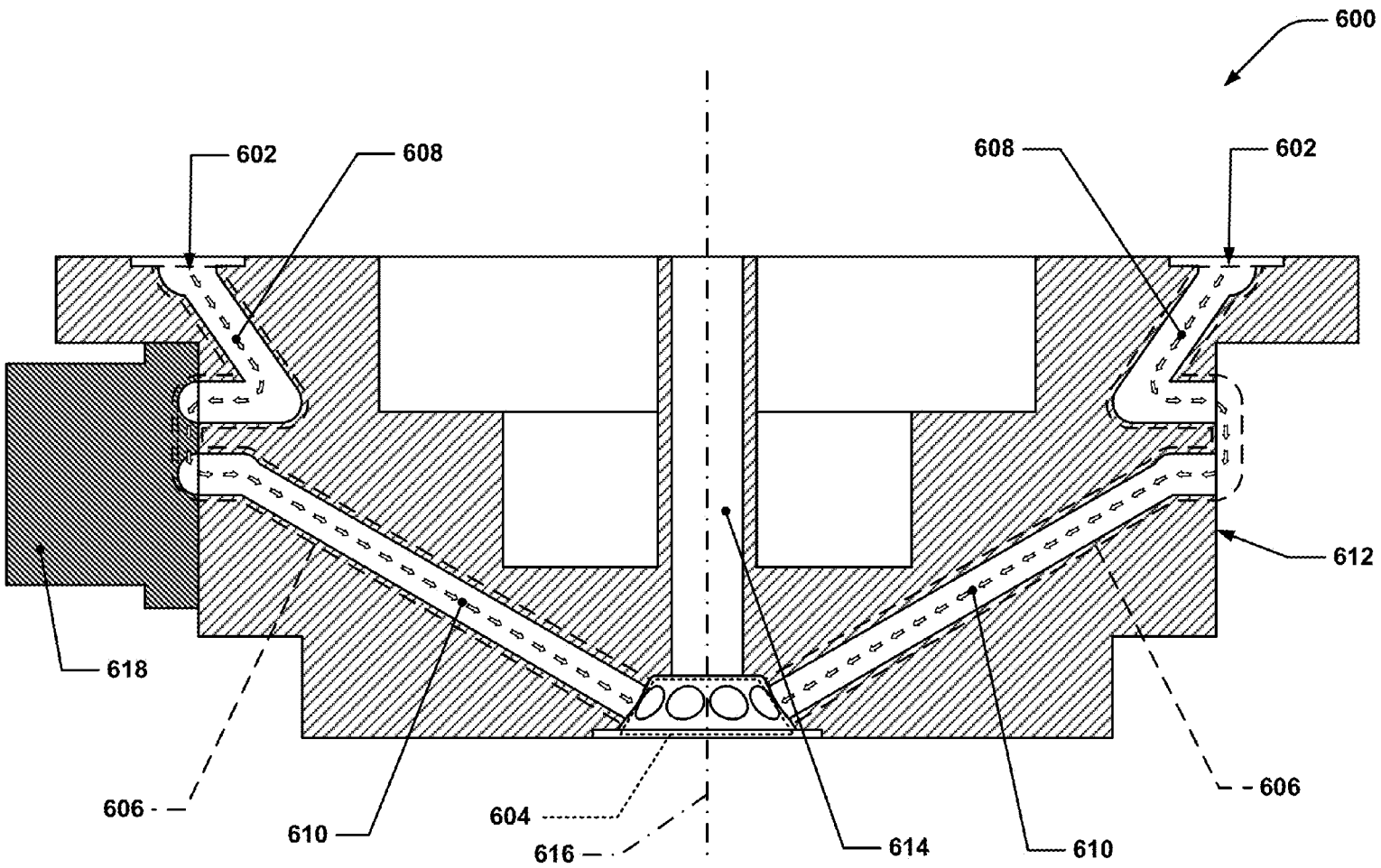
FIG. 6 depicts a section view of an alternate configuration in which the first valve interface is for a surface-mount valve.

FIG. 6 depicts a section view of an alternate configuration in which the first valve interface is for a surface-mount valve. In FIG. 6, the first hub 600 includes a plurality of first ports 602 that are arranged around a first axis 616. Each first port 602 may be fluidically connected with a first passage 608, which may lead to a first valve interface 612 (the first valve interface 612 on the left has a first valve 618, which is a surface-mount valve, connected to it, and is not separately called out; it is a mirror image of the first valve interface 612 on the right, however). A second passage 610 may lead from the first valve interface 612 to a mixing chamber 604, and an outflow pipe 614 may then lead from the mixing chamber 604 to, for example, a semiconductor processing tool. Each first passage 608, first valve interface 612, and second passage 610, in combination, may form a first flow path 606.

The first valve 618 is a surface-mount valve that is configured to be mounted to a flat surface with an inlet and an outlet port (these interfaces will generally include seals, but these are not shown). Such a face-mount valve will generally have internal flow paths or flow recesses that, when the valve is mounted to the flat surface, serve to define a contained flow path for the gas or liquid that is routed through the valve. As can be seen, a portion of the first flow path 606 is defined by the first valve 618. This portion is also indicated on the right side of FIG. 6 even though no first valve 618 is shown on the right side of FIG. 6. As discussed earlier, it is to be understood that the first flow path 606 of the first hub 600 is to be understood to refer to the fluid flow volume as it would exist in the hub assembly based on the architecture of the first hub 600 and with the first valve 618 installed, regardless of whether or not the first valve 618 is actually installed.

Returning to FIG. 2, in some configurations, each first valve interface 212 may be configured to interface with a valve with a valve mounting feature (not shown). Each first valve interface 212 may be of a cylindrical shape and/or may include a threaded bore such that a threaded valve may connect with the first valve interface 212. In some configurations, the valve mounting feature may include a pattern or threaded holes such that a valve with threaded bores may be affixed to the first valve interface 212.

Each first valve interface 212 may also be located between a first reference plane 230 that is perpendicular to the first axis 216 and passes through the corresponding first port 202, and a second reference plane 232 that is perpendicular to the first axis and passes through the first mixing chamber 204, as depicted, for example in FIG. 2. In some configurations, the first valve interfaces 212 may be located equidistant between the first and second reference planes, while in some other configurations they may be place closer to one reference plane than the other. In some configurations, one or more of the first valve interfaces 212 may be located at different locations between the first and second reference planes than one or more of the other first valve interfaces 212. For a non-limiting example, one or more first valve interface 212 may be located at a first distance away from the first reference plane and one or more of the other first valve interfaces 212 may be located at a second distance away from the first reference plane.

Figure 7:
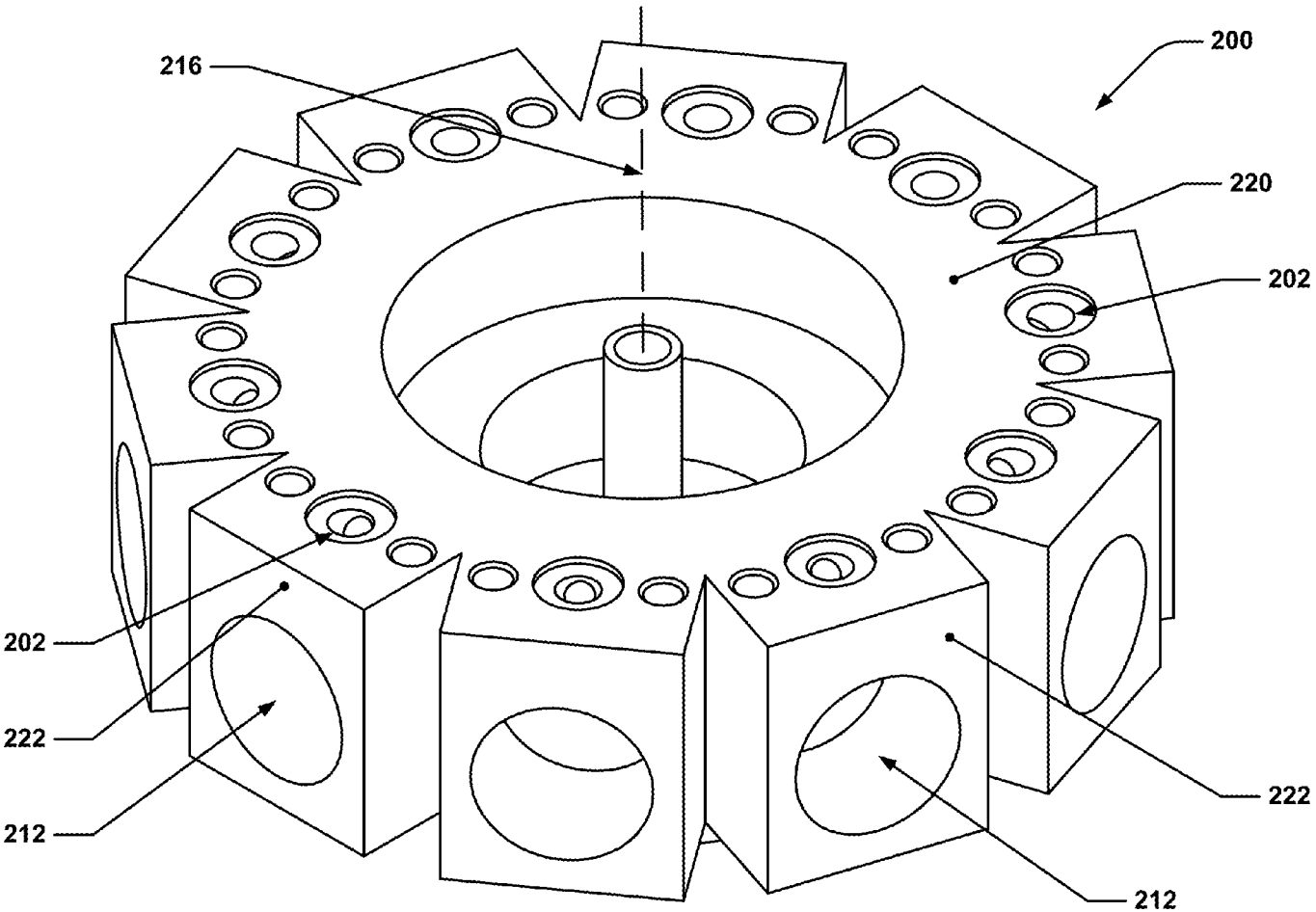
FIG. 7 depicts an isometric view of the example first hub of FIG. 2.

FIG. 7 depicts an isometric view of the example first hub of FIG. 2. The example first hub 200 is depicted and includes one first surface 220 and one second surface 222. In some configurations, all of the first ports 202 may be located on one first surface 220, as depicted in FIG. 7. In some other configurations, however, there may be more than one first surface 220 such that one or more of the first ports 202 may be located on discrete first surfaces 220. For instance, in one non-limiting example, the first hub may be configured such that each first port 202 is located on its own corresponding first surface 220 that is separate from the other first surfaces 220 although, perhaps, co-planar with the other first surfaces 220. Or, in another non-limiting example, some first ports 202 may be located on one first surface 220 while the remaining first ports 202 may be located on another first surface 220.

The first surface 220 in FIG. 7 is substantially perpendicular to the first axis 216. In some configurations, one or more of the first surfaces 220 may be oriented perpendicular to, or at different angles from, the first axis 216. The one or more first surfaces 220 may also be coplanar with one or more of the other first surfaces 220, or on one or more different planes from one or more of the other first surfaces 220.

In some configurations, there may also be a second surface 222 substantially perpendicular to the first surface 220 or the first reference plane 230. The first valve interfaces 212 are shown as cylindrical bores that extend through each of the second surfaces 222. The valve mounting feature described herein above (not shown), may also be configured onto the second surface 222 such that a first valve may be installed to interface with the first valve interface 212 using such a valve mounting feature. Some example valve mounting features on the second surface may include clamping features (such as flanges), threaded bores, or threaded holes. It is to be understood that the second surfaces may also be a non-planar surface or surfaces, e.g., the second surface may be a cylindrical or frusto-conical surface (or sections thereof)—such a configuration may be used when the first valves that are to be interfaced to the hub do not necessarily require a flat surface for mounting, as may be the case with some valves that thread into a threaded bore. It is to be further understood that the second surface(s) 222 may be substantially perpendicular to the first surface(s) 220 and/or the first reference plane 230, e.g., such second surfaces 222 may be ±10° from perpendicular and still be considered to be "substantially perpendicular."

As discussed above, in some configurations, the valve mounting feature of each first valve interface 212 may include a threaded bore and/or a pattern of threaded holes. In some configurations, the threaded bore (or each threaded hole in a pattern of threaded holes, if used) may include a center axis that is within ±10° of being parallel to the first surface 220.

As discussed, the first ports may be arranged about the first axis. In FIG. 7, the first ports 202 are arranged in a uniform circular pattern around the first axis 216, and each first port 202 is offset from the first axis by the same distance. In some configurations, the first ports 2 may be arranged in a circular pattern around the first axis 216 such that two or more of the first ports 202 may be offset from the first axis 216 by different distances. In a non-limiting example, some first ports 202 may be offset from the first axis 216 by a first distance and the remaining first ports 202 may be offset from the first axis 216 by a second distance.

In some configurations, the first hub may have at least three first ports. In FIG. 7, the first hub 200 includes ten first ports 202, but the depicted geometry may be readily adapted to include any number of first ports lower than ten; the same geometry may also be adapted to support larger numbers of first ports, but such adaptation may also require that the first mixing chamber 204 be enlarged (or the second passage 210 be reduced in diameter) or otherwise modified to allow each second passage 210 to join the first mixing chamber 204. Such adaptation may also require that the first ports 202 and/or first valve interfaces 212 be offset further from the first axis than in the depicted example so as to provide additional clearance for mounting fluid flow components to the first hub 200. It is to be understood that the above discussion, as well as some of the following paragraphs, may refer to components that are not explicitly called out in FIG. 7; in such instances, the components discussed are indicated in FIG. 2 or FIG. 3, and it is to be understood that such references are to the corresponding components in FIG. 7.

In some configurations the first passages 208 and the second passages 210 may be cylindrical in shape with a circular cross-section, for instance, as depicted in FIG. 3. In some configurations the first passages 208 and the second passages 210 may have the same diameter, while in other configurations they may have different diameters. One or more of the first passages 208 may also have different diameters from one or more of the other first passages 208; similarly, one or more of the second passages 210 may have different diameters from one or more of the other second passages 210. In some configurations, the first passages 208 and/or second passages 210 may be of different geometric shapes with different cross-sections. In some implementations, the first passages 208 and/or second passages 210 may be tapered or conical in shape, or have sections that are tapered or conical in shape.

Generally speaking, the majority of each first passage 208 and the majority of each second passage 210 may follow paths that are at oblique angles α and β, respectively, off the first reference plane 230. In some implementations, the absolute value of the difference between the first oblique angle α and the second oblique angle β may be 25° or less, 20° or less, or 15° or less.

Due to the angled nature of the first and second passages, each first flow path is much shorter in length than a corresponding flow path would be in a typical, conventional gas stick. For example, in the conventional gas stick of FIG. 1, the passage marked "A" may be thought of as corresponding in function to the first passage since the A passage conveys gas from a fluid flow component, e.g., the MFC 118, to a valve, e.g., the mixing valve 120, and the passage marked "B" may be thought of as corresponding in function to the second passage. As can be seen, the A passage and the B passage generally travel along rectilinear axes and therefore present a much more circuitous flow path than the first flow paths discussed herein. The hubs of the present disclosure thus provide a much more direct flow path from the fluid flow components, e.g., MFCs, to the mixing chamber than is possible using conventional gas stick configurations.

The first mixing chamber 204 may be offset from one of the first ports 202 in a direction that is parallel to the first axis 216 by a first distance. As depicted in FIG. 2, the first mixing chamber 204 is offset from the first ports 202 by a distance, i.e. the first mixing chamber 204 may be considered "below" the first ports relative to the orientation of FIG. 2; similarly, the first ports 202 may be considered towards the "top" of FIG. 2. In some configurations, the first mixing chamber 204 may also be located such that its center axis is coincident with the first axis 216. In other configurations, the first mixing chamber may be located such that its center axis is not coincident with the first axis 216.

The example first hub 200 depicted in FIGS. 2 and 3 further includes an outflow pipe 214 that is fluidically connected to the first mixing chamber 204 such that gas may flow from the first mixing chamber 204 into outflow pipe 214. In some configurations, the outflow pipe 214 may be connected to a gas delivery system of a semiconductor processing tool (not pictured) in which the gas may flow from the first mixing chamber 204, through the outflow pipe 214, and into the gas delivery system of the semiconductor processing tool.

In some implementations, the first mixing chamber 204 of the example first hub 200 may be, in part, fluidically open to the ambient environment, for instance, on the end opposite the outflow pipe 214 as depicted in FIGS. 2 and 3. This may permit the first mixing chamber 204 to be fluidically connected to the first mixing chamber of another example first hub, as is discussed in further detail below. This may also permit the first mixing chamber 204 to be fluidically connected to other components, such as an inlet pipe or other gas delivery component.

In some other implementations, the first mixing chamber 204 may be entirely sealed within the first hub 200 such that the only fluidic connections to the first mixing chamber 204 are the first outflow pipe 214 and the second passages 210. Some such implementations may permit the use of only a single first hub in a semiconductor manufacturing tool. Some such implementations may be manufactured using 3D printing techniques, casting techniques, injection molding techniques, and/or using traditional machining processes. The first hub 200 may be made from a variety of different types of materials that are suitable for handling semiconductor processing chemicals. For example, the first hub 200 may be made from stainless steel, ceramic, ceramic composites, or other blended materials.

In some implementations, the example first hub 200 may not have an outflow pipe. In some such implementations, the first mixing chamber of the example first hub may be fluidically connected with the first mixing chamber of another first hub which does have an outflow pipe. In some such implementations, the two first mixing chambers are fluidically connected, but only one mixing chamber may have an outflow pipe.

The first mixing chamber 204 may be of an angled cylindrical shape, as depicted, for instance in FIGS. 2 and 3. In some implementations, the first mixing chamber 204 may be hemispherical in shape. In some implementations, the first mixing chamber 204 may be configured to a different shape and/or size depending on, for example, the nature of the fluid flowing into the first mixing chamber 204 and/or the semiconductor manufacturing process.

Figure 8:
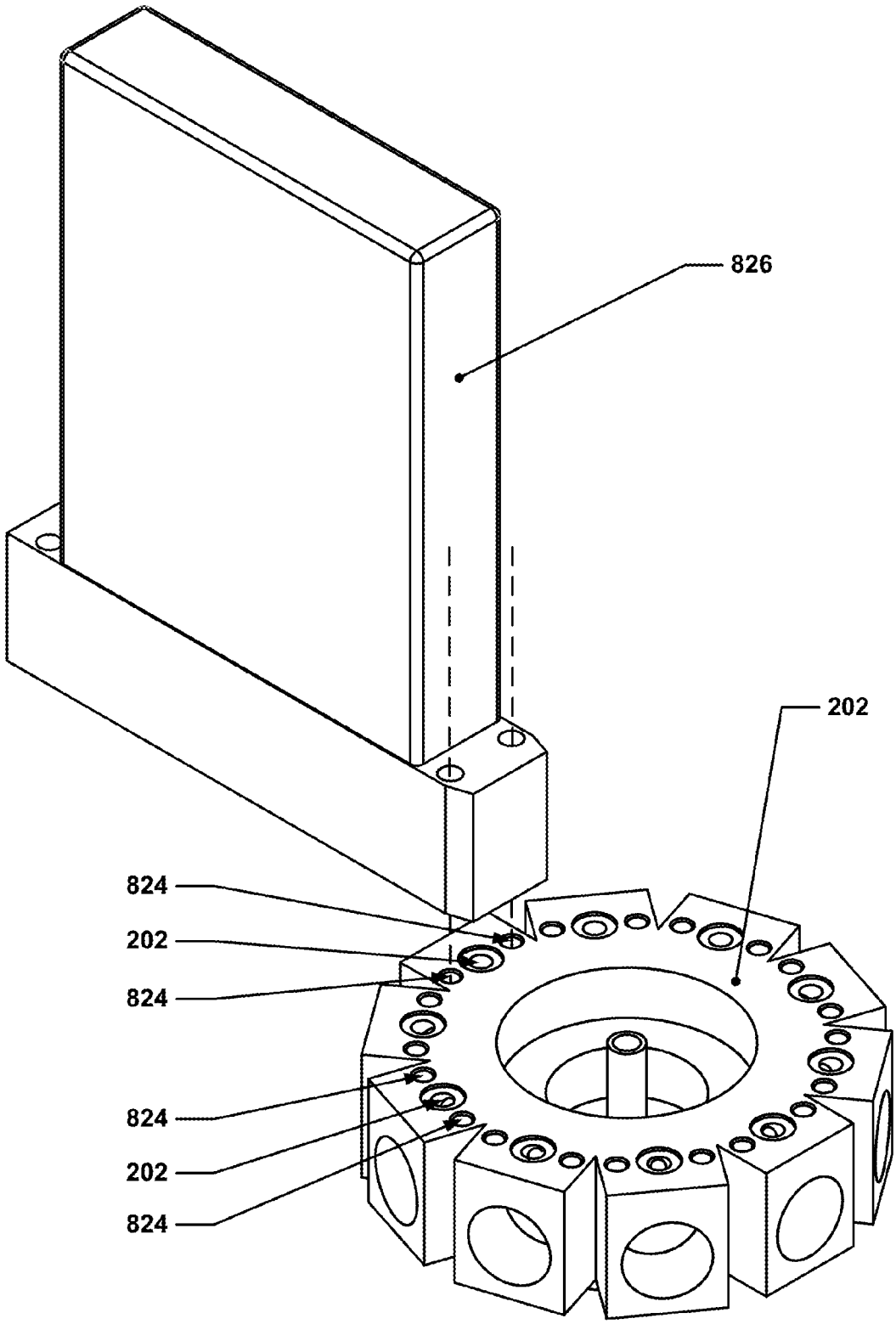
FIG. 8 depicts an isometric exploded view of the example first hub and one example first fluid flow component.

FIG. 8 depicts an isometric exploded view of the example first hub 200 and one example first fluid flow component. As can be seen, FIG. 8 shows the example first hub 200, which includes first mounting features 824, and a first fluid flow component 826. The first mounting features 824 may be configured to mount first fluid flow component 826 to the first hub 200 so as to fluidically connect each first fluid flow component 826 to a corresponding first port 202. The first hub 200 may be configured such that the first mounting features 824 may fluidically connect a plurality of first fluid flow components 826 such that each first fluid flow component 826 may be fluidically connected with one corresponding first port 202. Some non-limiting examples of the first mounting features 824 may include one or more holes through which a bolt may pass, threaded holes in which screws may be secured, and clamps. In some implementations, one or more of the first mounting features 824 may be different from one or more of the other first mounting features 824. For instance, one first mounting feature 824 may be two threaded holes, while another first mounting feature 824 may be smooth holes through which a bolt may pass. In some configurations, each first port 202 may have one corresponding first mounting feature or set of first mounting features 824 such that one first fluid flow component 826 may be fluidically connected to the first port 202.

Figure 9:
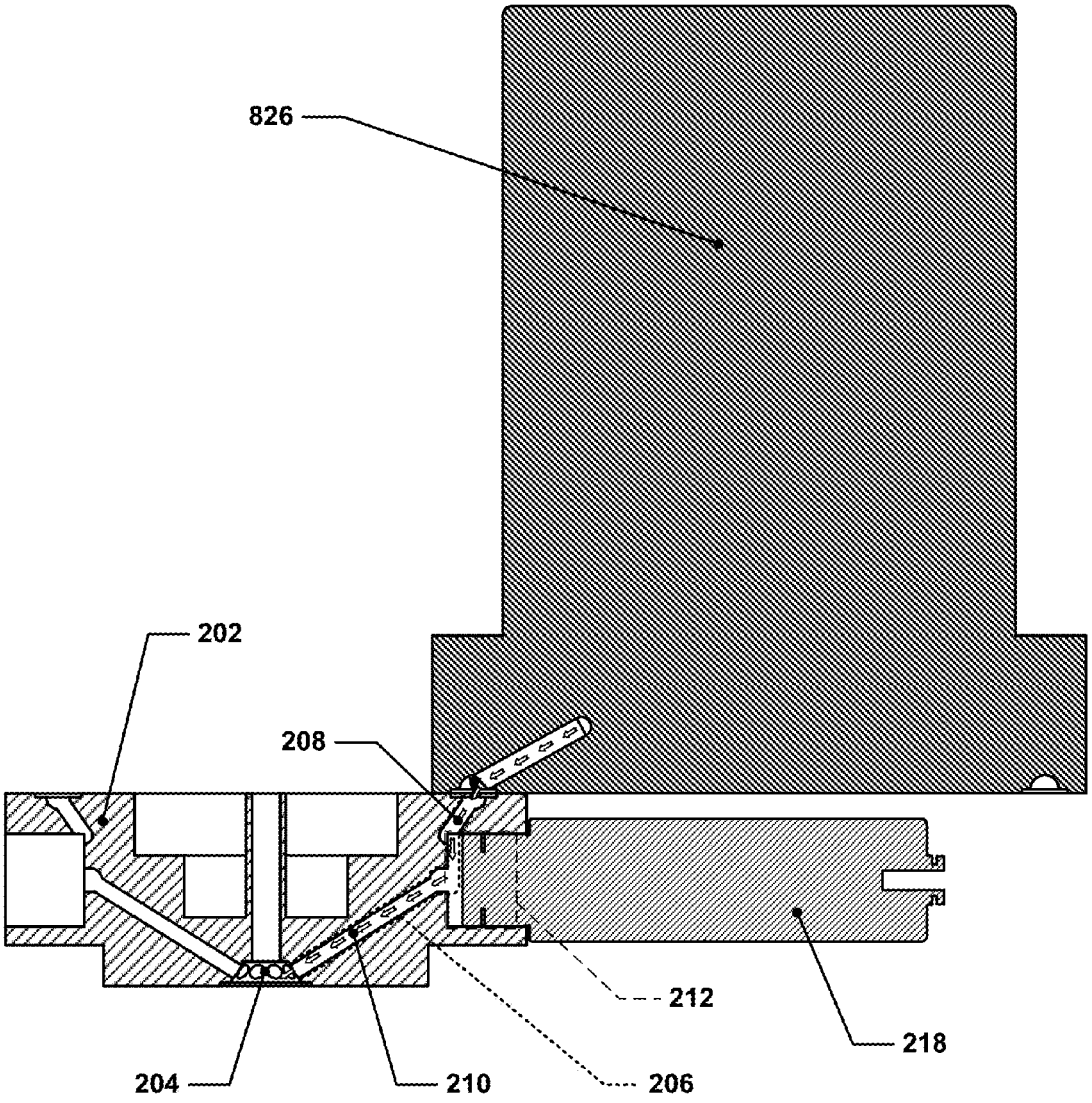
FIG. 9 depicts a cross-sectional view of an example first hub and an example first fluid flow component and first valve.

FIG. 9 depicts a cross-sectional view of an example first hub and an example first fluid flow component and first valve 218. As can be seen, the first fluid flow component 826 (most of the internal features/flow paths within the first fluid flow component 826 are not shown) is depicted as fluidically connected to the first port 202 of the example first hub 200 such that a fluid may flow (as shown with the white arrows) from the first fluid flow component 826 to the first port 202, and then along the first flow path 206, which may include the first passage 208, the first valve interface 212, and the second passage 210, and then into the first mixing chamber 204.

In some implementations, the first fluid flow components 826 may be MFCs. The details of the gas supply to the MFCs are not depicted here, but such MFCs may be supplied with gases or liquids, for example, using hardware similar to that used in conventional gas sticks. For instance, the first fluid component 826 may include an inlet port 828 through which gas and/or liquid may be supplied into the first fluid component and which may be connected to a fluid source, e.g., a facility gas source.

Figure 10:
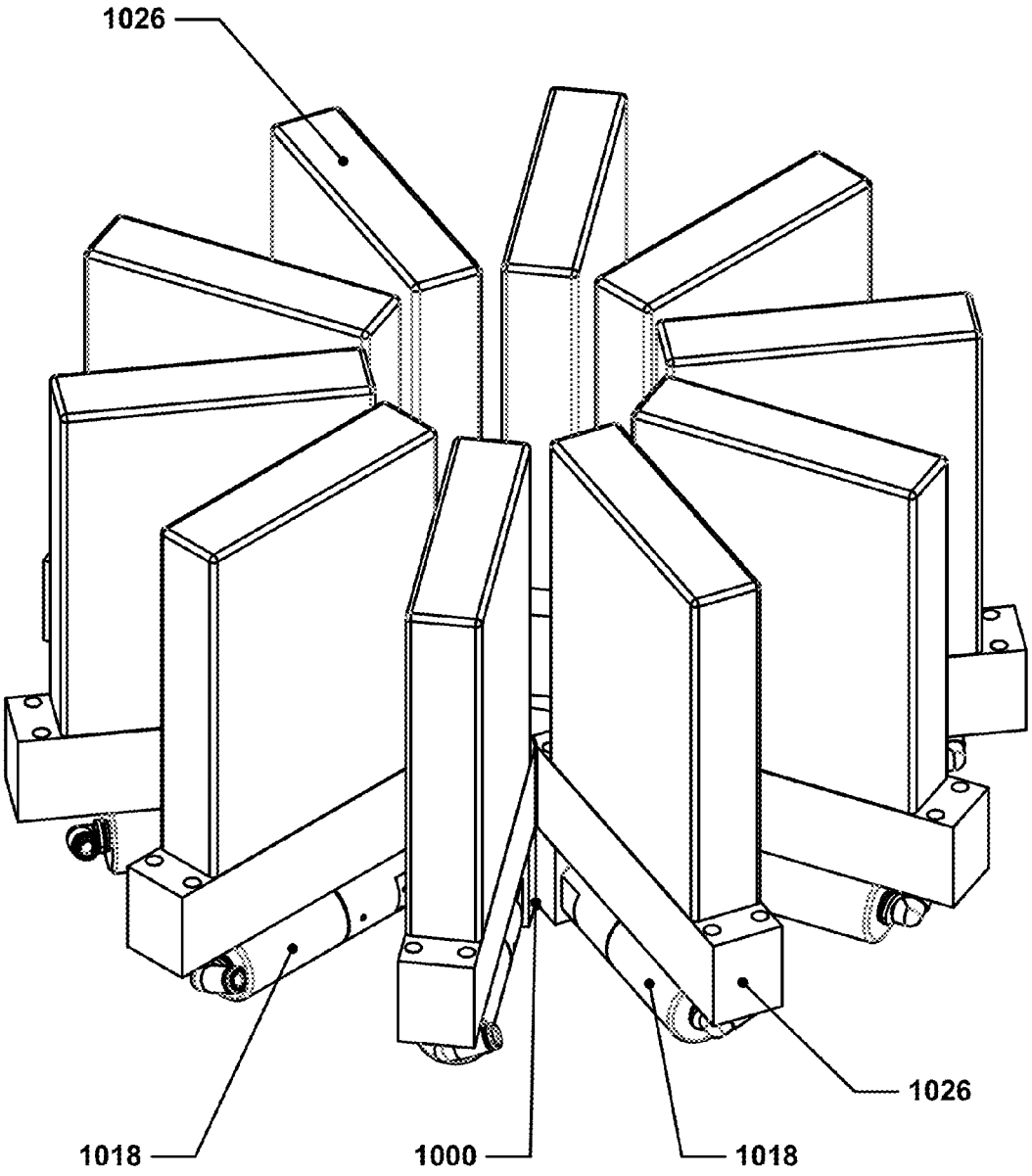
FIG. 10 depicts an isometric view of the example first hub with first fluid flow components and first valves installed.

FIG. 10 depicts an isometric view of the example first hub with first fluid flow components and first valves installed. As can be seen, the first hub 1000 is depicted with a plurality of first fluid flow components 1026, which are, in this case, MFCs, that are each mounted on the first hub 1000 using the first mounting features (the fasteners are not shown) such that each first fluid flow component 1026 is fluidically connected with one corresponding first port and a corresponding first flow path, and with a corresponding number of first valves 1018 that are each interfaced with a corresponding first valve interface. The first hub 1000 depicted in FIG. 10 may be configured to fluidically connect with the first fluid flow components 1026 and to interface with the example first valves 1018 as previously described hereinabove.

Figure 11:
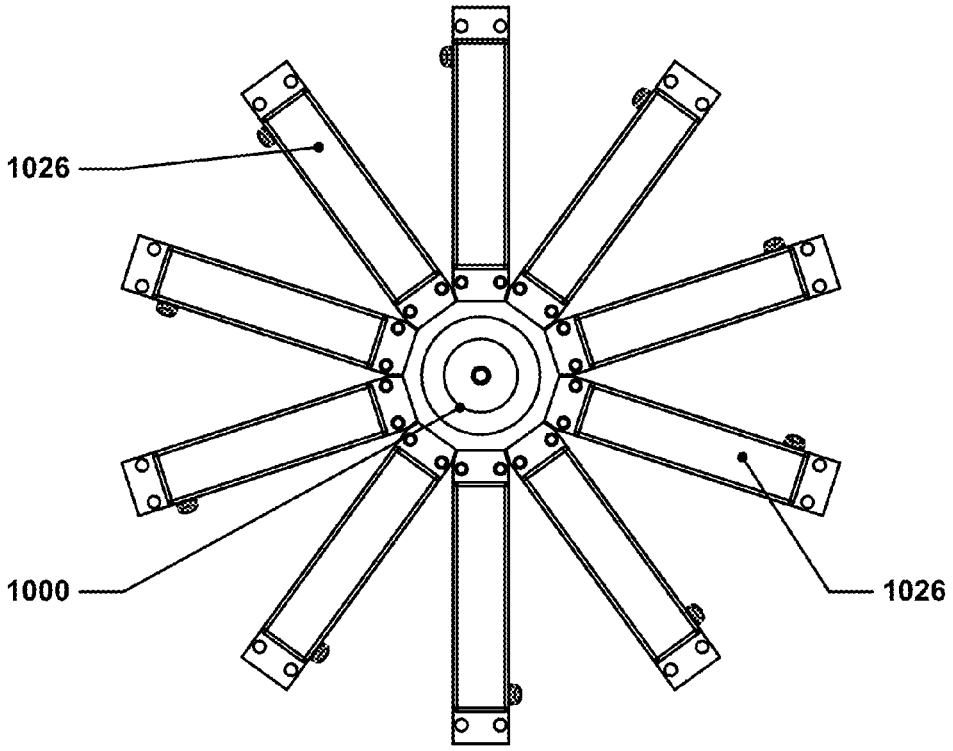
FIG. 11 depicts a top view of the example first hub of FIG. 10.

FIG. 11 depicts a top view of the example first hub 1000. This "top" view is a view from a direction parallel to the first axis. For the example first hub 1000 depicted in FIG. 11, the first mounting features and the first valve interfaces are configured such that when each first valve is interfaced with a corresponding one of the first valve interfaces, and each one of the first fluid flow components is mounted to the first hub using the first mounting features such that the first fluid flow component and the first valve fluidically interface with a corresponding one of the first ports and first flow paths, respectively, each first fluid flow component 1026 completely overlaps the corresponding first valve (the fitting on the end of each first valve is barely visible, but the bodies of the first valves are completely obscured) that is fluidically connected to the same first flow path when viewed along a direction parallel to the first axis. In some implementations, the degree of overlap may be less than 100%, e.g., only part of each first valve may be overlapped by a corresponding first fluid flow component from this viewpoint.

Figure 12:
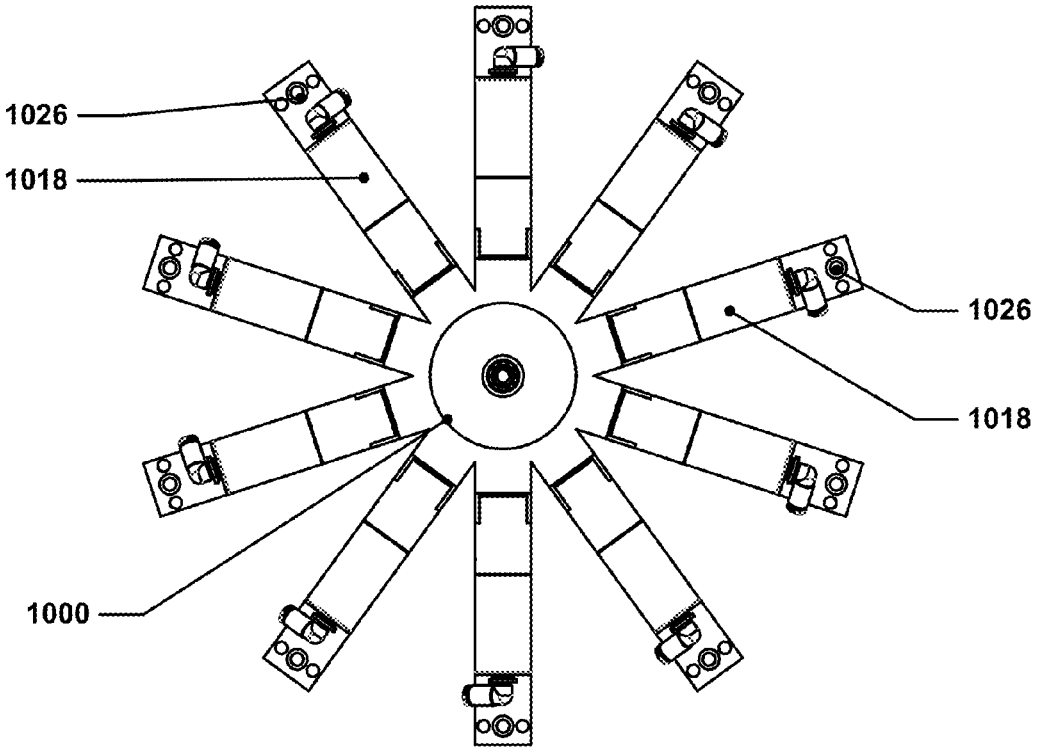
FIG. 12 depicts a bottom view of the example first hub of FIG. 10.

FIG. 12 depicts a bottom view of the example first hub 1000. This "bottom" view is a view from a direction parallel to the first axis and opposite the viewing direction in FIG. 11. The example first hub 1000 depicted in FIG. 12 is the same first hub 1000 as in FIGS. 10 and 11. As can be seen in FIG. 12, the configurations of the first mounting features and the first valve interfaces may result in each of the first valves 1018 overlapping, at least in part, each corresponding first fluid flow component 1026 that is fluidically connected to the same first flow path, when viewed from a direction parallel to the first axis. In some configurations, the sizes of one or more of the example first valves 1018 and/or first fluid flow components 1026 may vary which may result in less "overlap" between these components.

In some embodiments, the valve actuation axis of one or more of the first valves 1018 may be parallel to the surface to which the corresponding first fluid flow component 1026 mounts.

Figure 13:
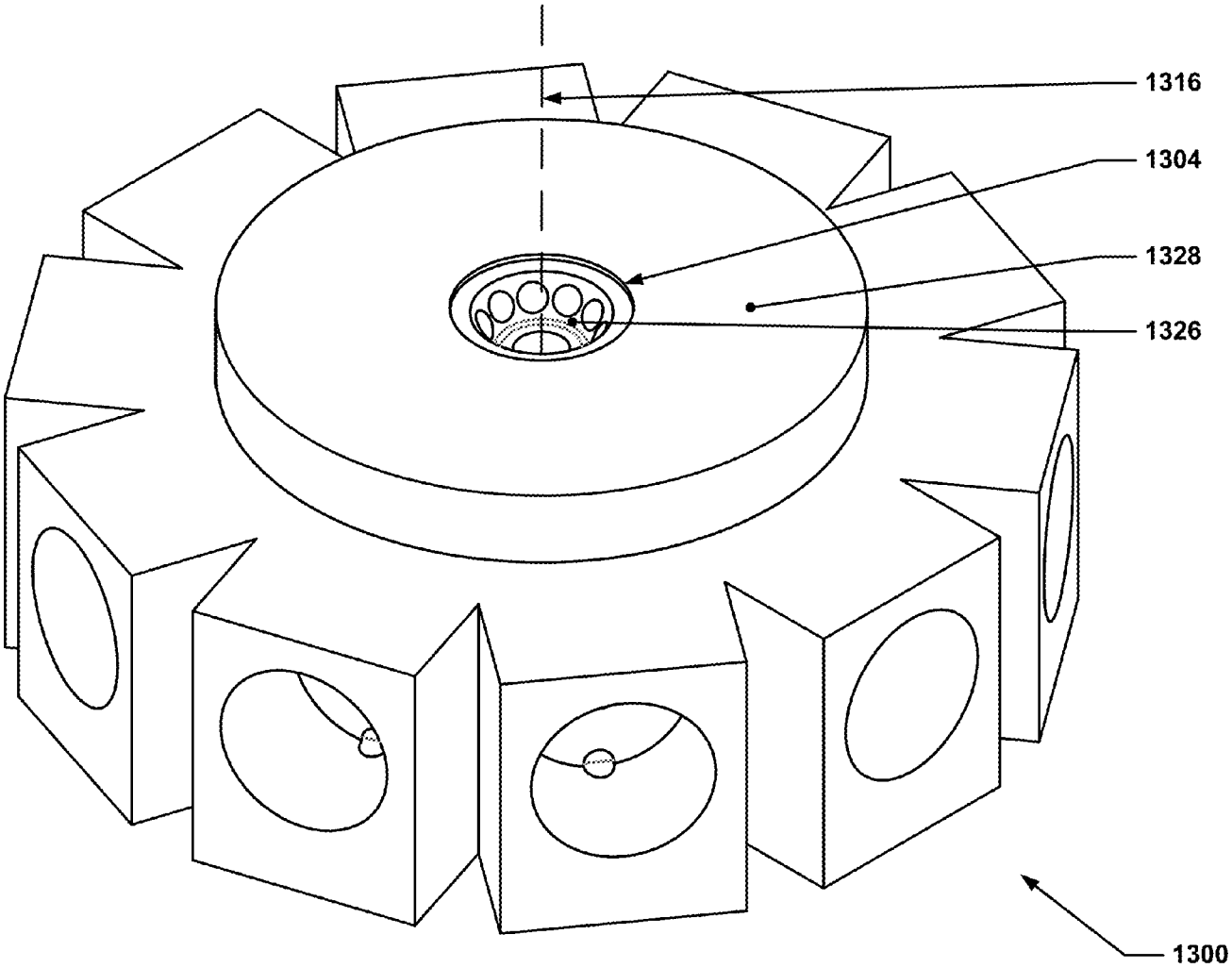
FIG. 13 depicts a different isometric view of the example first hub.

FIG. 13 depicts a different isometric view of the example first hub. As can be seen, the example first hub 1300 is shown but it is flipped approximately 180° from FIG. 7, so that the first surface 220 of the example first hub in 200 that was on the "top" surface in FIG. 7 is now the "bottom" surface of the example first hub 1300 and the first axis 216 is in the same position. The example first hub 1300 includes the first mixing chamber 1304, the first axis 1316, and a third surface 1328. The third surface may be configured to be offset from one of the first ports (not shown) in a direction parallel to the first axis 1316 by a first distance. Such configuration may be similar to the configuration of the first mixing chamber discussed hereinabove. The first mixing chamber 1326 may extend through the third surface 1328, for example, as depicted in FIG. 13. The third surfaces 1328 of two first hubs 1300 may be configured to mate to one another such that the two first mixing chambers of the two hubs are fluidically connected. In some configurations, the two third surfaces of each first hub may have features (not shown) that may connect the two first hubs together in order to fluidically connect the two first mixing chambers. Such features may include, for example, through-holes or threaded holes that allow bolts or screws to be used to clamp the two first hubs together. The mixing chambers 1304 of the two hubs may be joined together using a seal (not shown) that may provide for a gas-tight interface between the two hubs. In some embodiments, the two mixing chambers may be combined such that they are one piece; such a piece may be machined, cast, molded, formed using additive manufacturing techniques, or formed using a combination of two or more such techniques.

Figure 14:
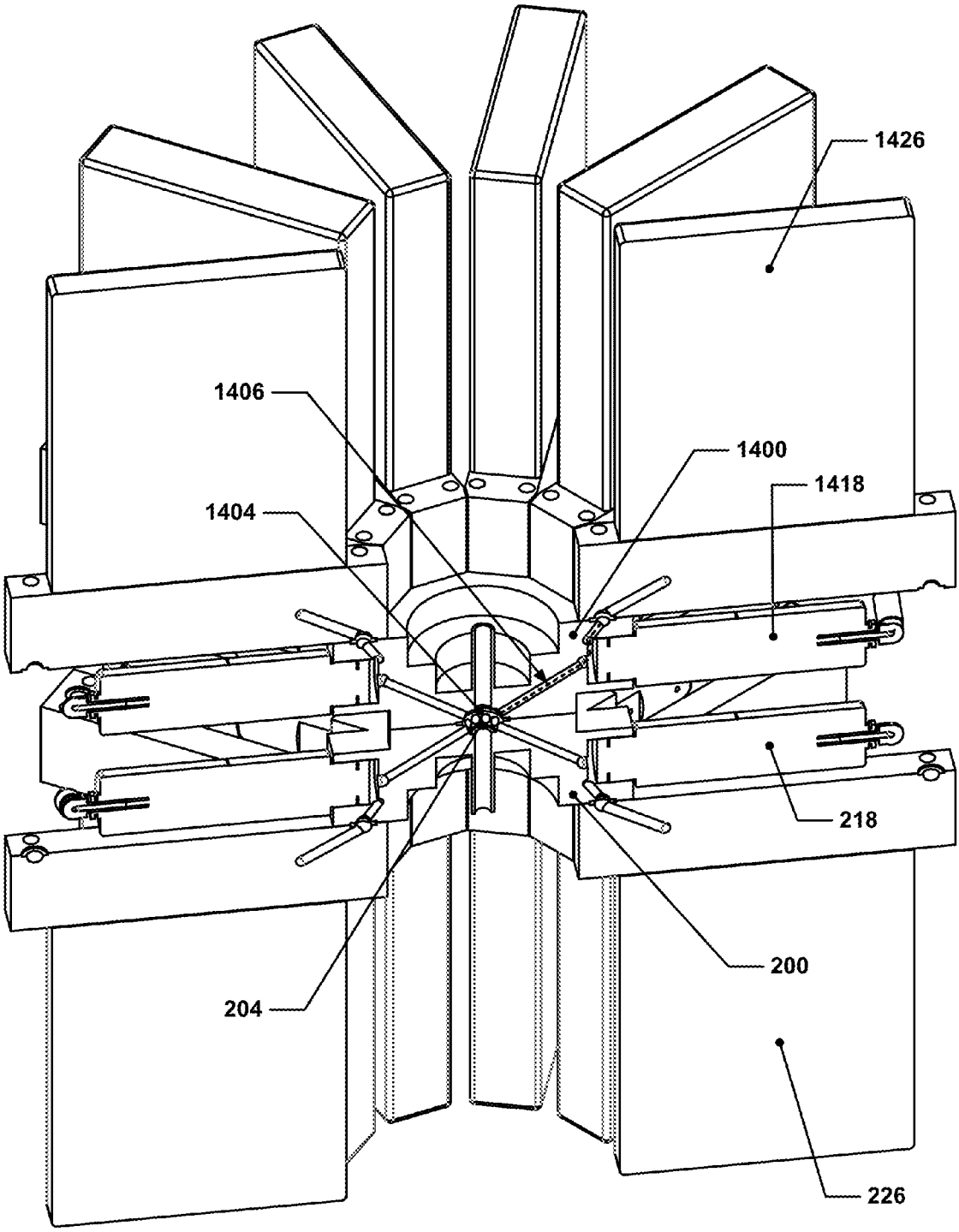
FIG. 14 depicts an isometric cutaway view of a first hub and a second hub assembled together.

FIG. 14 depicts an isometric cutaway view of a first hub and a second hub assembled together. In FIG. 14, the second hub is essentially the same as the first hub, but is rotated 180 degrees and mated to the first hub. The two hubs in FIG. 14 are configured similarly to the first hub 200 in the above discussion. For brevity and spatial considerations, only some illustrative features of the first hub and second hub are labeled in FIG. 14, reference may be made to the earlier discussion herein regarding the first hub 200 for discussion of features not explicitly labeled in FIG. 14.

As can be seen in FIG. 14, the first hub 200 is on the "underside" of the second hub 1400 (with respect to the orientation of the Figure), may be configured as previously described, and includes a plurality of example first valves 218, a plurality of first fluid flow components 226, and a first mixing chamber 204. The second hub 1400 in FIG. 14, may include a plurality of second fluid flow components 1426, a plurality of second valves 1418, a second flow path 1406, and a second mixing chamber 1404. The first hub and second hub may be configured such that the first mixing chamber 204 and the second mixing chamber 1404 are fluidically connected when the two hubs are assembled together. The second hub 1400, as described above for the example first hub, may be configured such that the plurality of second fluid flow components are fluidically connected to the second flow paths 1406 via corresponding second ports, which may allow a fluid to travel from the second fluid flow components 1426 through the second flow paths 1406 and into the second mixing chamber 1404. In some configurations, the first valve interfaces of the first hub (not identified) and the second valve interfaces of the second hub (not identified) may be configured to mount secondary valves or mixing valves.

The example first valves 218 may be configured, as described above, to regulate the flow between the first passages (not labeled) and second passages (not labeled) of the first hub 200, i.e., fluid flow along the first flow paths. Similarly, the example second valves 1418 may be configured to regulate the flow between the first passages and second passages of the second hub 1400, i.e., fluid flow along the second flow paths 1406. The example first valves 218 and the example second valves 1418 of FIG. 14 are shown in an "open" position which allows fluid to flow from the first and second fluid flow components to the first and second mixing chambers. In actual practice, different first valves and second valves may be opened or closed, as needed, to deliver (or not deliver) their respective gases or liquids to the mixing chamber formed by the mixing chambers 204 and 1404.

In some embodiments, the apparatus that results from assembling the first hub and the second hub together may be manufactured as a single, unibody piece. In other words, instead of manufacturing a separate first hub and a separate second hub, then connecting them together, the first hub and the second hub may be manufactured such that they are one solitary piece. Some such implementations may be manufactured using 3D printing techniques, casting techniques, injection molding techniques, and/or traditional machining processes. Such implementations may be made from a variety of different types of materials that are suitable for handling semiconductor processing chemicals, and may include, for instance, stainless steel, composite, ceramic, or other mixtures.

Figure 16:
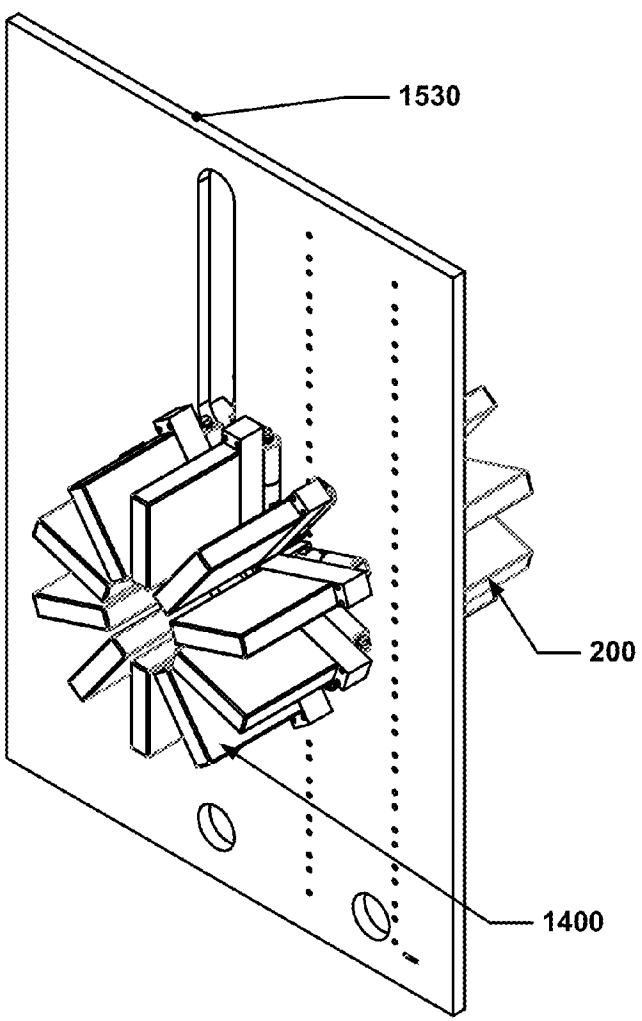
FIG. 16 depicts an isometric, non-exploded view of the example hubs and the example mounting plate of FIG. 15.
Figure 15:
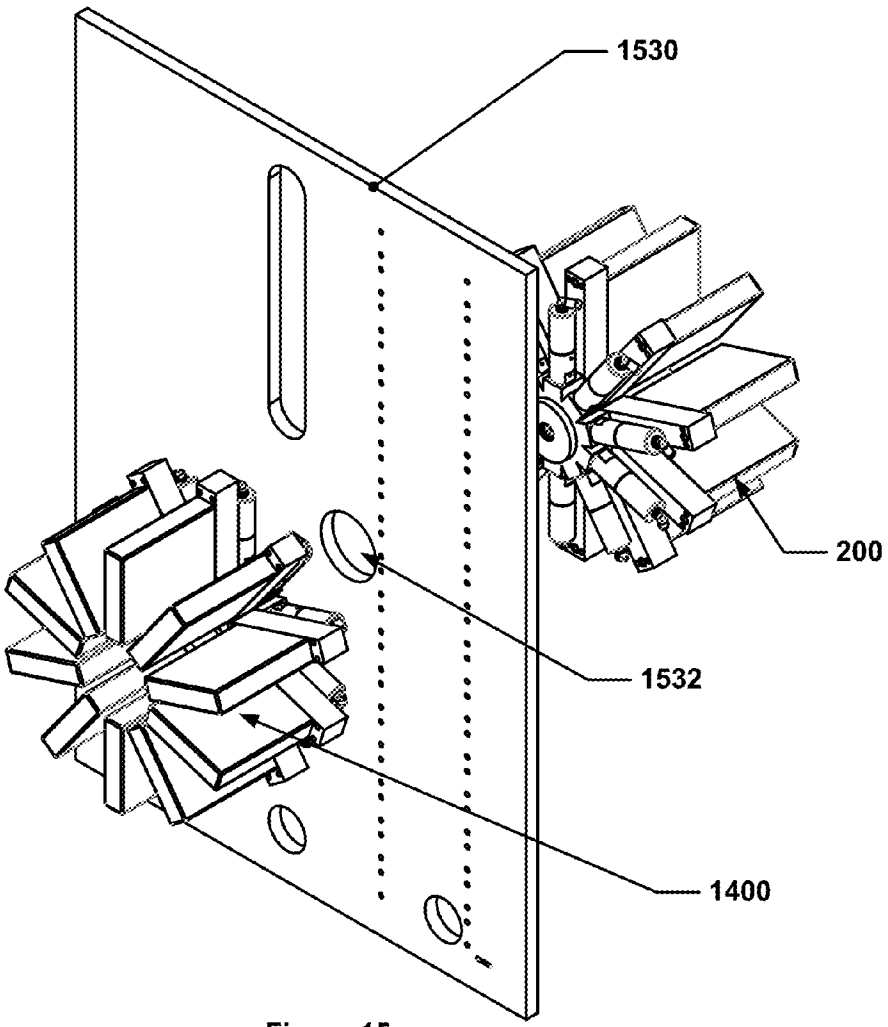
FIG. 15 depicts an isometric exploded view of two example hubs and an example mounting plate.

FIG. 15 depicts an isometric exploded view of two example hubs and an example mounting plate. FIG. 1 depicts an isometric, non-exploded view of the example hubs and the example mounting plate of FIG. 15. As can be seen in FIGS. 15 and 16, the first hub 200 and the second hub 1400 may be connected to a plate 1530. As depicted in FIG. 15, the plate 1530 has a hole 1532 through which at least some of the first hub 200 and second hub 1400 may pass such that the plate is sandwiched between the first hub 200 and the second hub 1400. The plate 1530 may also include a plurality of smaller holes which may be configured to provide mounting locations for a variety of other components, e.g., other fluid flow flow components. The plate 1530 may also be configured to be installed in a semiconductor processing tool.

It is to be understood that the hubs and hub assemblies discussed herein may be provided as piece parts, e.g., as a single hub, pairs of hubs (either assembled or disassembled), as hubs assembled with fluid flow flow components (such as MFCs and/or valves), as part of a complete gas box, or as part of a semiconductor processing tool. The hubs, as described herein, may be fluidically connected with a plurality of gas or liquid supply sources, and to one or more process chambers in a semiconductor processing tool. The fluid flow components may be connected to a controller that may control the operation of the fluid flow components. The controller may include one or more processors and memory for storing instructions to control the one or more processors to perform various operations, e.g., turn on or off valves, adjust the flow rates of reactants through MFCs, etc.

Unless the context of this disclosure clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also generally include the plural or singular number respectively. When the word "or" is used in reference to a list of two or more items, that word covers all of the following interpretations of the word: any of the items in the list, all of the items in the list, and any combination of the items in the list. The term "implementation" refers to implementations of techniques and methods described herein, as well as to physical objects that embody the structures and/or incorporate the techniques and/or methods described herein.

There are many concepts and implementations described and illustrated herein. While certain features, attributes and advantages of the implementations discussed herein have been described and illustrated, it should be understood that many others, as well as different and/or similar implementations, features, attributes and advantages of the present inventions, are apparent from the description and illustrations. As such, the above implementations are merely exemplary. They are not intended to be exhaustive or to limit the disclosure to the precise forms, techniques, materials and/or configurations disclosed. Many modifications and variations are possible in light of this disclosure. It is to be understood that other implementations may be utilized and operational changes may be made without departing from the scope of the present disclosure. As such, the scope of the disclosure is not limited solely to the description above because the description of the above implementations has been presented for the purposes of illustration and description.

Importantly, the present disclosure is neither limited to any single aspect nor implementation, nor to any single combination and/or permutation of such aspects and/or implementations. Moreover, each of the aspects of the present disclosure, and/or implementations thereof, may be employed alone or in combination with one or more of the other aspects and/or implementations thereof. For the sake of brevity, many of those permutations and combinations will not be discussed and/or illustrated separately herein.

What is claimed is:

1. An apparatus comprising:

a first hub that is a single piece and includes:

a plurality of first ports arranged about a first axis, a plurality of first valve interfaces, each first valve interface includes one or more surfaces, a plurality of first passages, a plurality of second passages, a first mixing chamber offset from one of the first ports in a direction parallel to the first axis by a first distance, and a plurality of first flow paths, wherein each of the first flow paths fluidically connects a corresponding one of the first ports to the first mixing chamber and each first flow path comprises one first passage, one second passage, and one first valve interface, and wherein, for each first flow path of the first hub:

the first passage extends through a surface of the first valve interface, extends through the first hub, and fluidically connects the corresponding first port with the first valve interface, the second passage extends through a surface of the first valve interface, extends through the first hub, and fluidically connects the first valve interface with the first mixing chamber, the first valve interface is fluidically interposed between the first passage and the second passage, each first valve interface is configured to interface with a first valve such that the first valve, when installed, is able to regulate fluid flow between the first passage and the second passage, and the first valve interface is located between a first reference plane that is perpendicular to the first axis and passes through the corresponding first port and a second reference plane that is perpendicular to the first axis and passes through the first mixing chamber.

2. The apparatus of claim 1, wherein the first ports are arranged in a first radial pattern around the first axis.

3. The apparatus of claim 1, wherein the first hub includes at least three first ports, three first valve interfaces, three first passages, three second passages, and three first flow paths.

4. The apparatus of claim 1, wherein the first mixing chamber is hemispherical in shape.

5. The apparatus of claim 1, wherein each first valve interface includes a valve mounting feature selected from the group consisting of a threaded bore and a pattern of threaded holes.

6. The apparatus of claim 5, wherein:

the threaded bore or threaded holes have a center axis or center axes that are within 10° of perpendicular to the first axis.

7. The apparatus of claim 1, wherein the first hub further comprises one or more first surfaces and one or more second surfaces, wherein:

each first port is located on one of the one or more first surfaces, each second surface is substantially perpendicular to the first surface, and each first valve interface extends through one of the one or more second surfaces.

8. The apparatus of claim 1, wherein the first hub further comprises a first outflow pipe, wherein the first outflow pipe is fluidically connected to the first mixing chamber.

9. The apparatus of claim 1, wherein the first hub further includes first mounting features configured to mount a plurality of first fluid flow components to the first hub such that each first fluid flow component is fluidically connected with a corresponding one of the first flow paths via one of the first ports.

10. The apparatus of claim 9, wherein the first mounting features and the first valve interfaces are configured such that when one of the first valves is interfaced with one of the first valve interfaces and one of the first fluid flow components is mounted to the first hub using the first mounting features such that the first valve and the first fluid flow component fluidically interface with a corresponding one of the first flow paths, the first fluid flow component and the first valve overlap, at least in part, when viewed from a direction parallel to the first axis.

11. The apparatus of claim 10, further comprising:

a plurality of first fluid flow components, and a plurality of first valves, wherein:

each first fluid flow component is mounted to the first hub using the first mounting features such that each first fluid flow component is fluidically connected with a corresponding one of the first ports, and each first valve is interfaced with a corresponding one of the first valve interfaces.

12. The apparatus of claim 1, wherein:

the first passages are at a first oblique angle off the first reference plane, and the second passages are at a second oblique angle off the first reference plane.

13. The apparatus of claim 12, wherein the absolute value of the difference between the first oblique angle and the second oblique angle is 20° or less.

14. The apparatus of claim 1, wherein the first hub further comprises a third surface, wherein:

the third surface is offset from one of the first ports in a direction parallel to the first axis by a first distance, the first mixing chamber extends through the third surface, and the third surface is configured to fluidically connect the first mixing chamber with a first mixing chamber of another hub.

15. The apparatus of claim 1, further comprising:

a second hub that is a single piece and includes:

a plurality of second ports arranged about a second axis, a plurality of second valve interfaces, each second valve interface includes one or more surfaces, a plurality of third passages, a plurality of fourth passages, a second mixing chamber offset from one of the second ports in a direction parallel to the second axis by a second distance, a plurality of second flow paths, wherein each of the second flow paths fluidically connects a corresponding one of the second ports to the second mixing chamber and each second flow path comprises one third passage, one fourth passage, and one second valve interface, and wherein, for each second flow path of the second hub:

the third passage extends through a surface of the second valve interface, extends through the first hub, and fluidically connects the corresponding second port with the second valve interface, the fourth passage extends through a surface of the second valve interface, extends through the first hub, and fluidically connects the second valve interface with the second mixing chamber, the second valve interface is fluidically interposed between the third passage and the fourth passage, each second valve interface is configured to interface with a second valve such that the second valve, when installed, is able to regulate fluid flow between the third passage to the fourth passage, and the second valve interface is located between a third reference plane that is perpendicular to the second axis and passes through the corresponding second port, and a fourth reference plane that is perpendicular to the second axis and passes through the second mixing chamber; and an outflow pipe that is fluidically connected to an item selected from the group consisting of the first mixing chamber and the second mixing chamber, wherein the first hub and the second hub are assembled together such that the first mixing chamber is fluidically connected to the second mixing chamber.

16. The apparatus of claim 15, further comprising a plate that is sandwiched between the first hub and the second hub when the first hub and the second hub are assembled together.

17. The apparatus of claim 15, wherein:

the first hub further includes first mounting features configured to mount a plurality of first fluid flow components to the first hub such that each first fluid flow component is fluidically connected with a corresponding one of the first ports, and the second hub further includes second mounting features configured to mount a plurality of second fluid flow components to the second hub such that each second fluid flow component is fluidically connected with a corresponding one of the second ports.

18. The apparatus of claim 17, wherein:

the first mounting features and the first valve interfaces are configured such that when one of the first valves is interfaced with one of the first valve interfaces and one of the first fluid flow components is mounted to the first hub using the first mounting features such that the first valve and the first fluid flow component fluidically interface with a corresponding one of the first flow paths, the first fluid flow component and the first valve overlap, at least in part, when viewed from a direction parallel to the first axis, and the second mounting features and the second valve interfaces are configured such that when one of the second valves is interfaced with one of the second valve interfaces and one of the second fluid flow components is mounted to the second hub using the second mounting features such that the second valve and the second fluid flow component fluidically interface with a corresponding one of the second flow paths, the second fluid flow component and the second valve overlap, at least in part, when viewed from a direction parallel to the second axis.

19. The apparatus of claim 18, further comprising:

a plurality of first fluid flow components, a plurality of first valves, a plurality of second fluid flow components, a plurality of second valves, wherein:

each first fluid flow component is mounted to the first hub using the first mounting features such that each first fluid flow component is fluidically connected with a corresponding one of the first ports, each first valve is interfaced with a corresponding one of the first valve interfaces, each second fluid flow component is mounted to the second hub using the second mounting features such that each second fluid flow component is fluidically connected with a corresponding one of the second ports, and each second valve is interfaced with a corresponding one of the second valve interfaces.

20. The apparatus of claim 1, further comprising:

a plurality of first fluid flow components, each fluid flow component mounted to the first hub and in fluidic communication with a different one of the first flow paths;

a plurality of first valves, each first valve mounted to the first hub and in fluidic communication with a corresponding one of the first flow paths through one of the first valve interfaces;

at least one semiconductor processing chamber;

a gas distribution system configured to supply gas to the semiconductor processing chamber; and a controller including at least one memory and at least one processor, wherein:

the first hub is fluidically connected with the gas distribution system, the memory stores computer-executable instructions for controlling the plurality of first fluid control components and the plurality of first valves to cause desired quantities of process gases, process liquids, or process gases and process liquids to be delivered to the first mixing chamber and then to the at least one semiconductor processing chamber by way of the gas distribution system.

* * * * *